US011436985B2

(12) United States Patent
Park et al.

(10) Patent No.: US 11,436,985 B2
(45) Date of Patent: Sep. 6, 2022

(54) DISPLAY APPARATUS HAVING DIFFERENT DRIVING FREQUENCIES FOR MOVING AND STILL IMAGE MODES AND METHOD THEREOF

(71) Applicant: Samsung Display Co., Ltd., Yongin-Si (KR)

(72) Inventors: Sehyuk Park, Seongnam-si (KR); Hongsoo Kim, Hwaseong-si (KR); Jinyoung Roh, Hwaseong-si (KR); Hyojin Lee, Seongnam-si (KR); Jaekeun Lim, Suwon-si (KR); Junheyung Jung, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/315,449

(22) Filed: May 10, 2021

(65) Prior Publication Data

US 2022/0036833 A1 Feb. 3, 2022

(30) Foreign Application Priority Data

Jul. 31, 2020 (KR) ..... 10-2020-0096055

(51) Int. Cl.
*G09G 3/3291* (2016.01)
*G09G 3/20* (2006.01)

(52) U.S. Cl.
CPC ..... *G09G 3/3291* (2013.01); *G09G 3/2003* (2013.01); *G09G 2310/027* (2013.01)

(58) Field of Classification Search
CPC ..... G09G 3/3291
USPC ..... 345/690
See application file for complete search history.

(56) References Cited

U.S. PATENT DOCUMENTS

2015/0022512 A1* 1/2015 Ahn ..... G09G 3/3614 345/212
2016/0124491 A1* 5/2016 An ..... G06F 1/3265 713/323
2017/0092191 A1* 3/2017 An ..... G09G 3/3233
2020/0211475 A1* 7/2020 Park ..... G09G 3/2007

FOREIGN PATENT DOCUMENTS

KR 10-2017-0005210 A 1/2017
KR 10-2070660 B1 1/2020

* cited by examiner

*Primary Examiner* — Long D Pham
(74) *Attorney, Agent, or Firm* — Innovation Counsel LLP

(57) ABSTRACT

A display apparatus includes a display panel including pixels, a gate driver applying a gate signal to a gate line, a data driver applying a data voltage to a data line and a driving controller determining a mode of an input image data to a moving image mode or a static image mode according to whether the input image data is a moving image or a static image, driving the display panel in a moving image driving frequency in the moving image mode and in a static image driving frequency in the static image mode, operating the gate driver in an alternate driving mode such that the gate driver scans a first group of the gate lines in a first duration and a second group of the gate lines in a second duration and inserting a compensation frame to scan all of the gate lines when an image transition is occurred in the static image mode.

20 Claims, 15 Drawing Sheets

DISPLAY APPARATUS HAVING DIFFERENT DRIVING FREQUENCIES FOR MOVING AND STILL IMAGE MODES AND METHOD THEREOF

PRIORITY STATEMENT

This application claims priority under 35 U.S.C. § 119 to Korean Patent Application No. 10-2020-0096055, filed on Jul. 31, 2020 in the Korean Intellectual Property Office KIPO, the contents of which are herein incorporated by reference in their entireties.

BACKGROUND

1. Field

Example embodiments of the present inventive concept relate to a display apparatus and a method of driving the display apparatus. More particularly, example embodiments of the present inventive concept relate to a display apparatus alternately driving a first group of gate lines and a second group of gate lines for a static image and a method of driving the display apparatus.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver. In addition, the display panel driver may further include a power voltage generator applying a power voltage and an initialization voltage to the display panel.

The driving controller may determine a driving frequency of a display panel based on input image data. When the input image data represent a static image, the driving controller may drive the display panel in a relatively low driving frequency so that a power consumption of the display apparatus may be reduced. When the display panel is driven in the low driving frequency, a display quality of the display panel may be deteriorated due to a flicker.

SUMMARY

Example embodiments of the present inventive concept provide a display apparatus preventing a flicker of a display panel to enhance a display quality.

Example embodiments of the present inventive concept also provide a method of driving the display apparatus.

In an example embodiment of a display apparatus according to the present inventive concept, the display apparatus includes a display panel, a gate driver, a data driver and a driving controller. The display panel includes a plurality of pixels. The display panel is configured to display an image based on input image data. The gate driver is configured to apply a gate signal to a gate line of the display panel. The data driver is configured to apply a data voltage to a data line of the display panel. The driving controller is configured to determine a mode of the input image data to a moving image mode or a static image mode according to whether the input image data is a moving image or a static image. The driving controller is configured to drive the display panel in a moving image driving frequency in the moving image mode and configured to drive the display panel in a static image driving frequency in the static image mode. The driving controller is configured to operate the gate driver in an alternate driving mode such that the gate driver scans a first group of the gate lines in a first duration and a second group of the gate lines in a second duration. When an image transition is occurred in the static image mode, the driving controller is configured to insert a compensation frame to scan all of the gate lines.

In an example embodiment, a length of the first duration of the alternate driving mode may be substantially the same as a length of the second duration of the alternate driving mode.

In an example embodiment, wherein a length of the compensation frame may be substantially the same as the length of the first duration of the alternate driving mode and the length of the second duration of the alternate driving mode.

In an example embodiment, the first group of the gate lines may be odd numbered gate lines. The second group of the gate lines may be even numbered gate lines.

In an example embodiment, a width of a gate pulse in the first duration of the alternate driving mode may be substantially the same as a width of a gate pulse in the compensation frame.

In an example embodiment, a width of a gate pulse in the first duration of the alternate driving mode may be equal to or greater than twice a width of a gate pulse in the compensation frame.

In an example embodiment, in the moving image mode, the driving controller may be configured to operate the gate driver in a normal driving mode such that the gate driver scans all of the gate lines.

In an example embodiment, the driving controller may include a static image determiner configured to determine whether the input image is the moving image or the static image, a driving frequency determiner configured to determine the moving image driving frequency and the static image driving frequency, a driving mode determiner configured to determine a driving mode of the display panel whether the driving mode is the alternate driving mode or the normal driving mode and a compensation frame inserter configured to insert the compensation frame.

In an example embodiment, when the image transition is occurred in the static image mode, the compensation frame inserter may be configured to compare a difference of a grayscale value of a previous image and a grayscale value of a present image to a grayscale threshold. When the difference of the grayscale value of the previous image and the grayscale value of the present image is greater than the grayscale threshold, the compensation frame inserter may be configured to insert the compensation frame.

In an example embodiment, when the static image driving frequency is equal to or greater than a frequency threshold, the driving mode determiner may be configured to operate the gate driver in a first alternate driving mode. When the static image driving frequency is less than the frequency threshold, the driving mode determiner may be configured to operate the gate driver in a second alternate driving mode.

In an example embodiment, the first group of the gate lines may be odd numbered gate lines and the second group of the gate lines may be even numbered gate lines in the first alternate driving mode.

In an example embodiment, in the second alternate driving mode, the gate driver scans one fourth of the gate lines in each of a first duration, a second duration, a third duration and a fourth duration.

In an example embodiment, at least one of the pixels may include a first pixel switching element including a control electrode connected to a first node, an input electrode connected to a second node and an output electrode connected to a third node, a second pixel switching element including a control electrode to which a data write gate signal is applied, an input electrode to which the data voltage is applied and an output electrode connected to the second node, a third pixel switching element including a control electrode to which the data write gate signal is applied, an input electrode connected to the first node and an output electrode connected to the third node, a fourth pixel switching element including a control electrode to which a data initialization gate signal is applied, an input electrode to which the initialization voltage is applied and an output electrode connected to the first node, a fifth pixel switching element including a control electrode to which the emission signal is applied, an input electrode to which a high power voltage is applied and an output electrode connected to the second node, a sixth pixel switching element including a control electrode to which the emission signal is applied, an input electrode connected to the third node and an output electrode connected to an anode electrode of an organic light emitting element, a seventh pixel switching element including a control electrode to which the data initialization gate signal is applied, an input electrode to which an initialization voltage is applied and an output electrode connected to the anode electrode of the organic light emitting element, and a storage capacitor including a first electrode to which the high power voltage is applied and a second electrode connected to the first node and the organic light emitting element including the anode electrode connected to the output electrode of the sixth pixel switching element and a cathode electrode to which a low power voltage is applied.

In an example embodiment of a method of driving a display apparatus, the method includes determining whether input image data is a moving image or a static image, determining a moving image driving frequency of a moving image mode and a static image driving frequency of a static image mode, operating a gate driver in an alternate driving mode such that the gate driver exclusively scans a first group of gate lines in a first duration and a second group of gate lines in a second duration and inserting a compensation frame to scan all of the gate lines when an image transition is occurred in the static image mode.

In an example embodiment, a length of the first duration of the alternate driving mode may be substantially the same as a length of the second duration of the alternate driving mode.

In an example embodiment, a length of the compensation frame may be substantially the same as the length of the first duration of the alternate driving mode and the length of the second duration of the alternate driving mode.

In an example embodiment, in the moving image mode, the gate driver may be operated in a normal driving mode such that the gate driver scans all of the gate lines.

In an example embodiment, the inserting the compensation frame may include comparing a difference of a grayscale value of a previous image and a grayscale value of a present image to a grayscale threshold when the image transition is occurred in the static image mode and inserting the compensation frame when the difference of the grayscale value of the previous image and the grayscale value of the present image is greater than the grayscale threshold.

In an example embodiment, when the static image driving frequency is equal to or greater than a frequency threshold, the gate driver may be operated in a first alternate driving mode. When the static image driving frequency may be less than the frequency threshold, the gate driver is operated in a second alternate driving mode.

In an example embodiment, the gate driver may exclusively scan odd numbered gate lines in a first duration and even numbered gate lines in a second duration in the first alternate driving mode, and wherein, the gate driver exclusively scans one fourth of the gate lines in each of a first duration, a second duration, a third duration and a fourth duration in the second alternate driving mode.

According to the display apparatus and the method of driving the display apparatus, the driving controller drives the display panel in the moving image driving frequency in the moving image mode, and the driving controller drives the display panel in the static image driving frequency in the static image mode. Thus, the power consumption of the display apparatus may be reduced.

In addition, in the static image mode, the driving controller may operate the gate driver in an alternate driving mode such that the gate driver scans the first group of the gate lines in a first duration and the second group of the gate lines in a second duration. Thus, the flicker due to a current leakage of the pixel may be prevented. In addition, when the image transition is occurred in the static image mode, the driving controller may insert the compensation frame to scan all the gate lines so that the flicker due to the luminance difference between the first frame and the second frame after the image transition in the static mode may be prevented. Thus, the display quality of the display panel may be enhanced.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
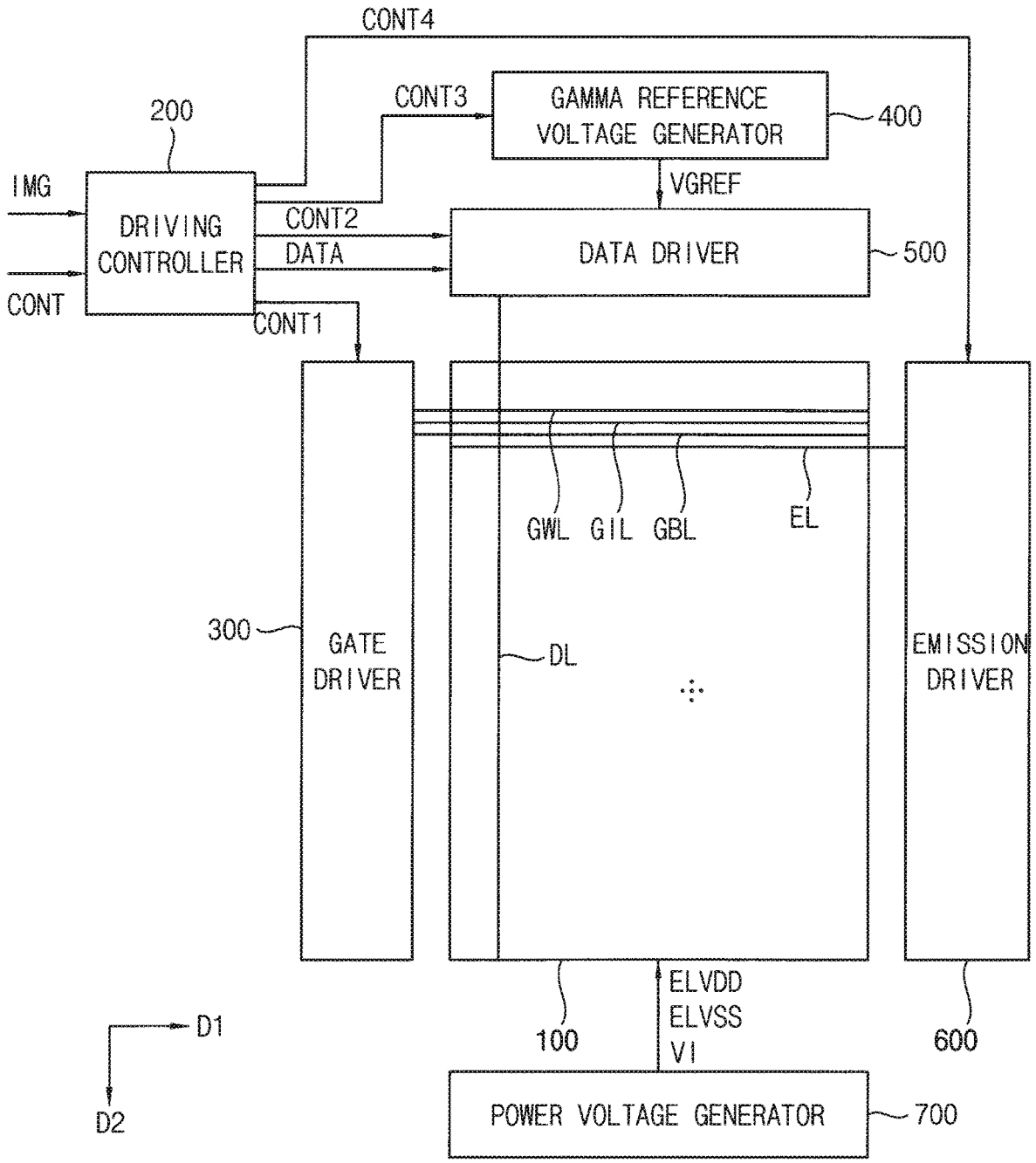
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 and the data driver 500 may be integrally formed in one integrated circuit chip (IC chip). The driving controller 200, the data driver 500 and the power voltage generator 700 may be integrally formed in one IC chip. The driving controller 200, the gamma reference voltage generator 400 and the data driver 500 may be integrally formed in one IC chip. The driving controller 200, the gate driver 300, the gamma reference voltage generator 400 and the data driver 500 may be integrally formed in one IC chip. The driving controller 200, the gate driver 300, the gamma reference voltage generator 400, the data driver 500 and the emission driver 600 may be integrally formed in one IC chip. The driving controller 200, the gate driver 300, the gamma reference voltage generator 400, the data driver 500, the emission driver 600 and the power voltage generator 700 may be integrally formed in one IC chip.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. The gate lines GWL, GIL and GBL extend in a first direction D1, the data lines DL extend in a second direction D2 crossing the first direction D1 and the emission lines EL extend in the first direction D1.

The driving controller 200 receives input image data IMG and an input control signal CONT from an external apparatus. The input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The gate driver 300 generates gate signals driving the gate lines GWL, GIL and GBL in response to the first control signal CONT1 received from the driving controller 200. The gate driver 300 may sequentially output the gate signals to the gate lines GWL, GIL and GBL. For example, the gate driver 300 may be formed on the display panel 100 directly. For example, the gate driver 300 may be integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be embedded in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may generate power voltage for operating the display panel 100 and the display panel driver. For example, the power voltage generator 700 may output a high power voltage ELVDD to a pixel circuit of the display panel 100. The power voltage generator 700 may output a low power voltage ELVSS to the pixel circuit of the display panel 100. The power voltage generator 700 may output an initialization voltage VI to the pixel circuit of the display panel 100.

Figure 2:
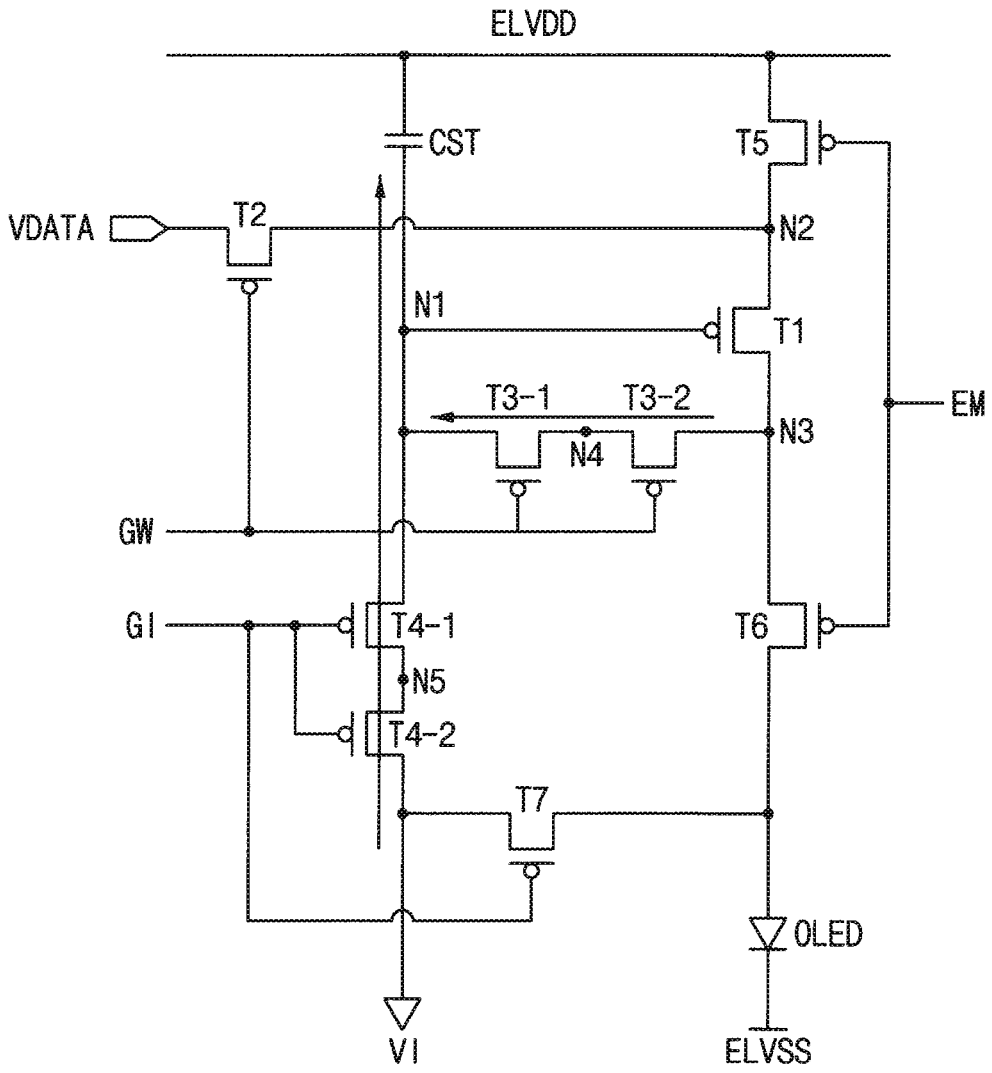
FIG. 2 is a circuit diagram illustrating a pixel of a display panel of FIG. 1.
Figure 3:
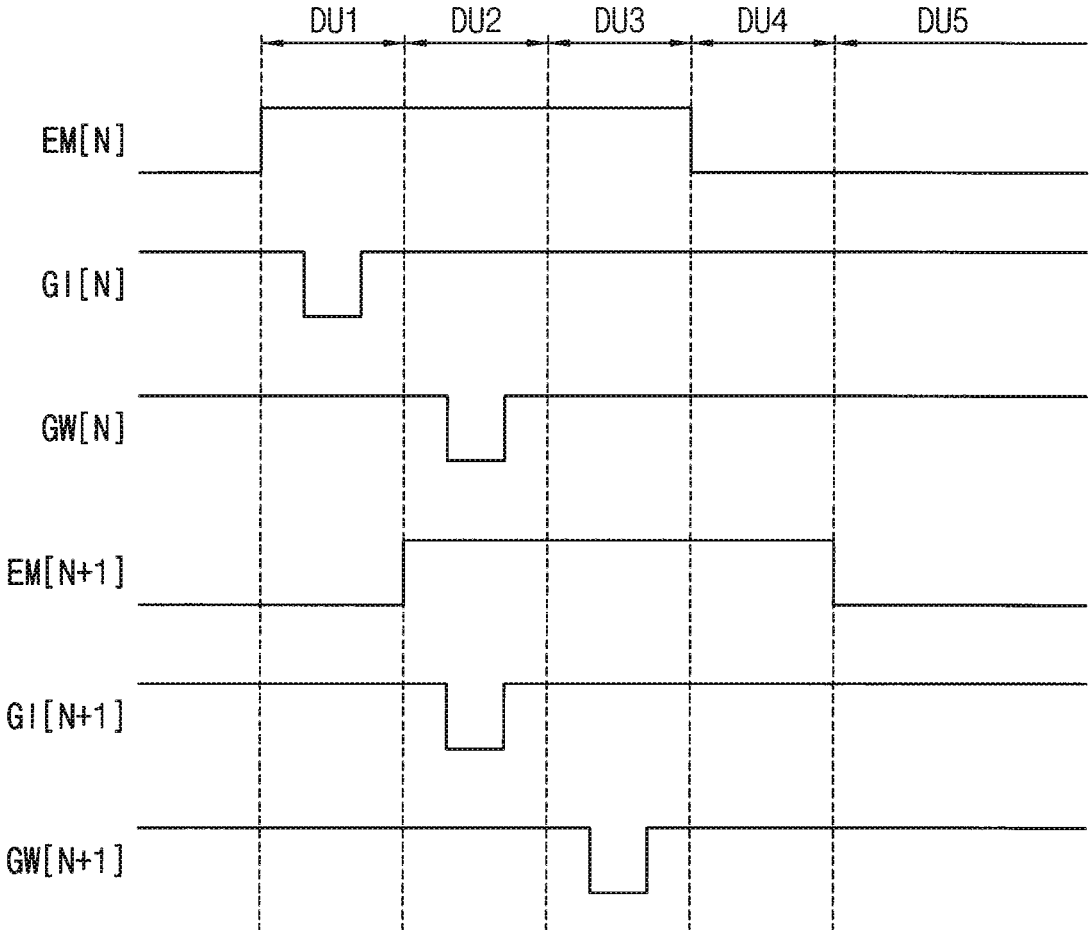
FIG. 3 is a timing diagram illustrating input signals applied to the pixel of FIG. 2.

FIG. 2 is a circuit diagram illustrating the pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

The pixels receive a data write gate signal GW, a data initialization gate signal GI, an organic light emitting element initialization gate signal, the data voltage VDATA and the emission signal EM and the organic light emitting elements OLED of the pixels emit light corresponding to the level of the data voltage VDATA to display the image. In the present example embodiment, the organic light emitting element initialization gate signal may be same as the data initialization gate signal GI.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3. The first pixel switching element T1 may be a P-type thin film transistor. The control electrode of the first pixel switching element T1 may be a gate electrode, the input electrode of the first pixel switching element T1 may be a source electrode and the output electrode of the first pixel switching element T1 may be a drain electrode.

The second pixel switching element T2 includes a control electrode to which the data write gate signal GW is applied, an input electrode to which the data voltage VDATA is applied and an output electrode connected to the second node N2. The second pixel switching element T2 may be a P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3-1 and T3-2 includes a control electrode to which the data write gate signal GW is applied, an input electrode connected to the first node N1 and an output electrode connected to the third node N3. The third pixel switching element T3-1 and T3-2 may be a P-type thin film transistor. The control electrode of the third pixel switching element T3-1 and T3-2 may be a gate electrode, the input electrode of the third pixel switching element T3-1 and T3-2 may be a source electrode and the output electrode of the third pixel switching element T3-1 and T3-2 may be a drain electrode.

As shown in FIG. 2, for example, the third pixel switching element may include two pixel switching elements T3-1 and T3-2 connected to each other in series. Unlike FIG. 2, the third pixel switching element may be configured as a single switching element.

The fourth pixel switching element T4-1 and T4-2 includes a control electrode to which the data initialization gate signal GI is applied, an input electrode to which an initialization voltage VI is applied and an output electrode connected to the first node N1. The fourth pixel switching element T4-1 and T4-2 may be a P-type thin film transistor. The control electrode of the fourth pixel switching element T4-1 and T4-2 may be a gate electrode, the input electrode of the fourth pixel switching element T4-1 and T4-2 may be a source electrode and the output electrode of the fourth pixel switching element T4-1 and T4-2 may be a drain electrode.

As shown in FIG. 2, for example, the fourth pixel switching element may include two pixel switching elements T4-1 and T4-2 connected to each other in series. Unlike FIG. 2, the fourth pixel switching element may be configured as a single switching element.

The fifth pixel switching element T5 includes a control electrode to which the emission signal EM is applied, an input electrode to which a high power voltage ELVDD is applied and an output electrode connected to the second node N2.

The fifth pixel switching element T5 may be a P-type thin film transistor. The control electrode of the fifth pixel switching element T5 may be a gate electrode, the input electrode of the fifth pixel switching element T5 may be a source electrode and the output electrode of the fifth pixel switching element T5 may be a drain electrode.

The sixth pixel switching element T6 includes a control electrode to which the emission signal EM is applied, an input electrode connected to the third node N3 and an output electrode connected to an anode electrode of the organic light emitting element OLED.

The sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GI is applied, an input electrode to which the initialization voltage VI is applied and an output electrode connected to the anode electrode of the organic light emitting element OLED.

The seventh pixel switching element T7 may be a P-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode connected to the output electrode of the sixth pixel switching element T6 and a cathode electrode to which a low power voltage ELVSS is applied.

In FIG. 3, in a pixel disposed in an N-th row, during a first duration DU1, the first node N1 and the storage capacitor CST are initialized in response to the data initialization gate signal GI[N]. During the first duration DU1, the anode electrode of the organic light emitting element OLED is initialized in response to the organic light emitting element initialization gate signal GI[N]. During a second duration DU2, a threshold voltage |VTH| of the first pixel switching element T1 is compensated and the data voltage VDATA of which the threshold voltage |VTH| is compensated is written to the storage capacitor CST in response to the data write gate signal GW[N]. During a fourth duration DU4, a fifth duration DU5 and after the fifth duration DU5, the organic light emitting element OLED emits the light in response to the emission signal EM[N] so that the pixels in the N-th row display the image.

In a pixel disposed in an (N+1)-th row, during the second duration DU2, the first node N1 and the storage capacitor CST are initialized in response to the data initialization gate signal GI[N+1]. During the second duration DU2, the anode electrode of the organic light emitting element OLED is initialized in response to the organic light emitting element initialization gate signal GI[N+1]. During a third duration DU3, a threshold voltage |VTH| of the first pixel switching element T1 is compensated and the data voltage VDATA of which the threshold voltage |VTH| is compensated is written to the storage capacitor CST in response to the data write gate signal GW[N+1]. During the fifth duration DU5 and after the fifth duration DU5, the organic light emitting element OLED emits the light in response to the emission signal EM[N+1] so that the pixels in the N-th row display the image.

In the pixel disposed in an N-th row, during the first duration DU1, the data initialization gate signal GI[N] may have an active level. For example, the active level of the data initialization gate signal GI[N] may be a low level. When the data initialization gate signal GI[N] has the active level, the fourth pixel switching element T4-1 and T4-2 of the pixel of the N-th row is turned on so that the initialization voltage VI may be applied to the first node N1.

During the first duration DU1, the organic light emitting element initialization gate signal GI[N] may have an active level. In the present example embodiment, the organic light emitting element initialization gate signal GI[N] may be same as the data initialization gate signal GI[N]. When the organic light emitting element initialization gate signal GI[N] has the active level, the seventh pixel switching element T7 of the pixel of the N-th row is turned on so that the initialization voltage VI may be applied to the anode electrode of the organic light emitting element OLED to initialize the organic light emitting element OLED.

In the pixel disposed in an N-th row, during the second duration DU2, the data write gate signal GW[N] may have an active level. For example, the active level of the data write gate signal GW[N] may be a low level. When the data write gate signal GW[N] has the active level, the second pixel switching element T2 and the third pixel switching element T3-1 and T3-2 of the pixel of the N-th row are turned on. In addition, the first pixel switching element T1 of the pixel of the N-th row is turned on in response to the initialization voltage VI stored in the storage capacitor CST.

A voltage which is subtraction an absolute value |VTH| of the threshold voltage of the first pixel switching element T1 from the data voltage VDATA may be charged at the storage capacitor CST of the pixel of the N-th row along a path generated by the first to third pixel switching elements T1, T2 and T3-1 and T3-2.

During the fourth duration DU4 and the fifth duration DU5, the emission signal EM[N] corresponding to the N-th row may have an active level. The active level of the emission signal EM[N] may be a low level. When the emission signal EM[N] has the active level, the fifth pixel switching element T5 and the sixth pixel switching element T6 of the pixel of the N-th row are turned on. In addition, the first pixel switching element T1 of the pixel of the N-th row is turned on by the threshold compensated data voltage stored in the storage capacitor CST.

Figure 4:
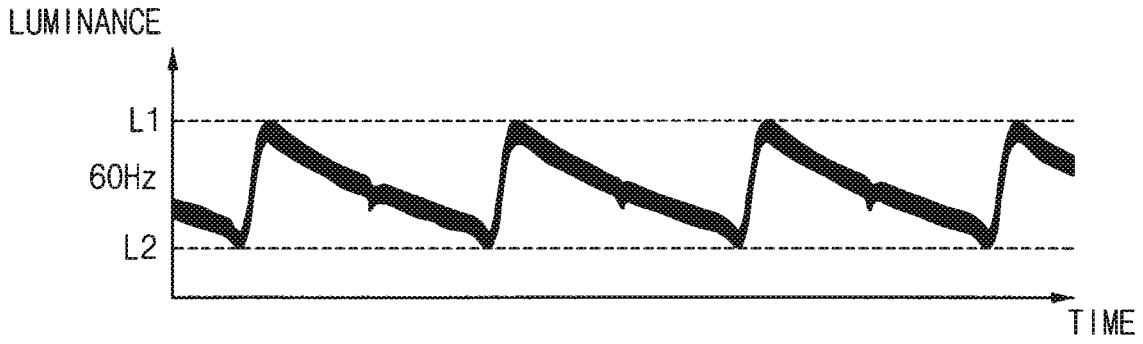
FIG. 4 is a graph illustrating a decrease of a luminance due to a current leakage of a pixel of FIG. 2 in a first driving frequency.
Figure 5:
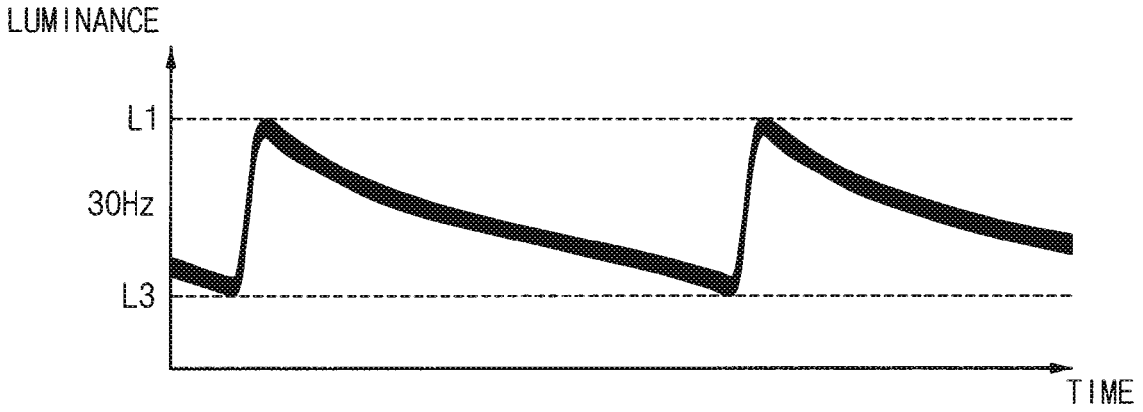
FIG. 5 is a graph illustrating a decrease of a luminance due to a current leakage of the pixel of FIG. 2 in a second driving frequency.

FIG. 4 is a graph illustrating a decrease of a luminance due to a current leakage of a pixel of FIG. 2 in a first driving frequency. FIG. 5 is a graph illustrating a decrease of a luminance due to a current leakage of the pixel of FIG. 2 in a second driving frequency.

Referring to FIGS. 1 to 5, the driving controller 200 may determine a display mode of the display panel whether it is a moving image mode or a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, the moving image driving frequency may be 60 Hz. Alternatively, the moving image driving frequency may be 120 Hz or 240 Hz. The static image driving frequency may be equal to or less than the moving image driving frequency. The driving controller 200 may properly determine the static image driving frequency according to the input image data IMG.

For example, the driving frequency may be 60 Hz in FIG. 4 and the driving frequency may be 30 Hz in FIG. 5. The current of the pixel may be leaked through the third pixel switching element T3-1 and T3-2 and the fourth pixel switching element T4-1 and T4-2. Due to the current leakage of the pixel, the luminance of the display panel 100 may be decreased. In FIG. 4, the driving frequency is relatively high and accordingly the data voltage VDATA is refreshed in a high frequency so that the decrease of the luminance due to the current leakage may be relatively small. For example, the luminance of the display panel 100 may be decreased from a first luminance L1 to a second luminance L2 due to the current leakage in FIG. 4. In contrast, in FIG. 5, the driving frequency is relatively low and accordingly the data voltage VDATA is refreshed in a low frequency so that the decrease of the luminance due to the current leakage may be relatively great. For example, the luminance of the display panel 100 may be decreased from the first luminance L1 to a third luminance L3 which is lower than the second luminance L2 due to the current leakage in FIG. 5. The decrease of the luminance in FIG. 5 may generate a flicker.

In a period when the pixel emits light, the voltages of the fourth node N4 and the fifth node N5 are floated so that the voltages of the fourth node N4 and the fifth node N5 may almost reach a high level of the gate signal, and thus, the leakage current may flow in a direction from the third pixel switching element T3-1 and T3-2 and the fourth pixel switching element T4-1 and T4-2 to the storage capacitor CST.

Figure 6:
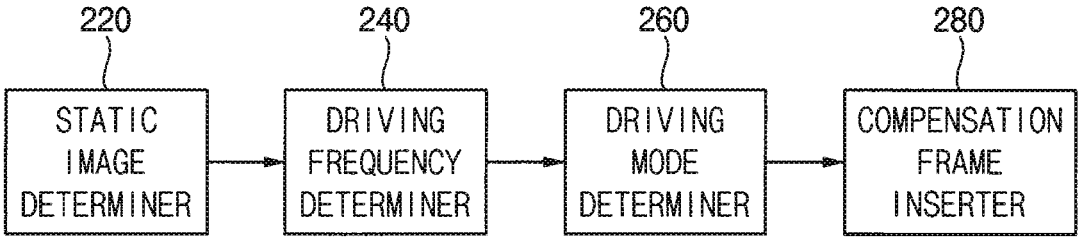
FIG. 6 is a block diagram illustrating a driving driver of FIG. 1.
Figure 7:
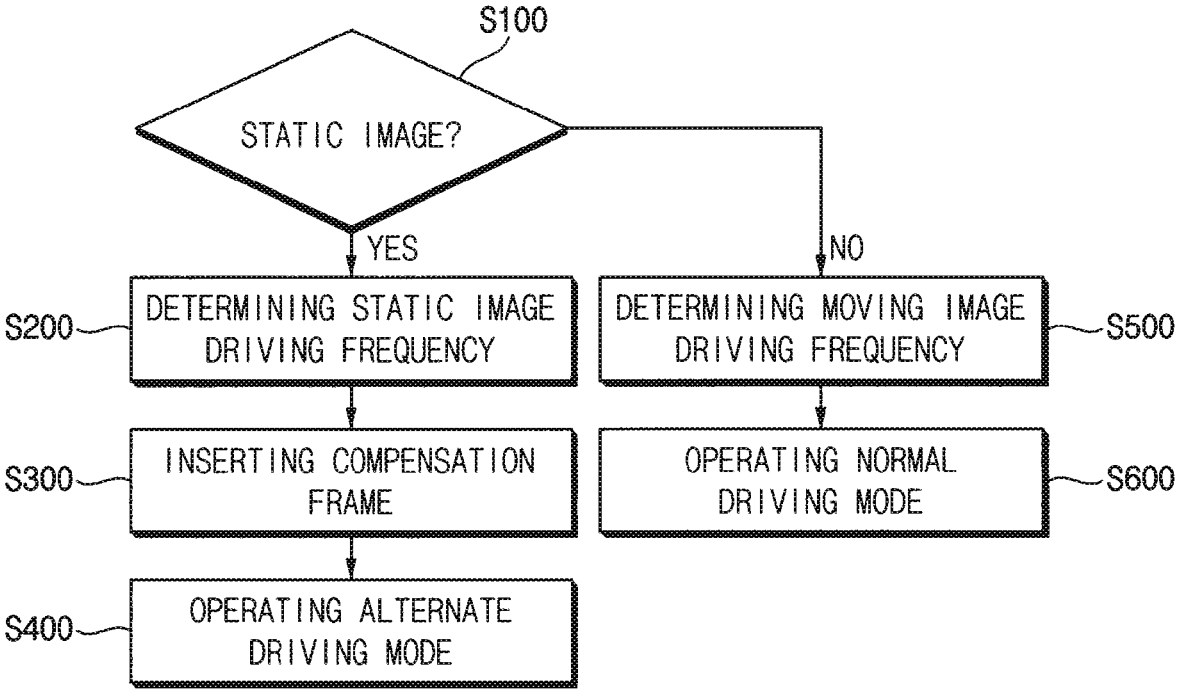
FIG. 7 is a flowchart diagram illustrating an operation of the driving driver of FIG. 1.
Figure 8:
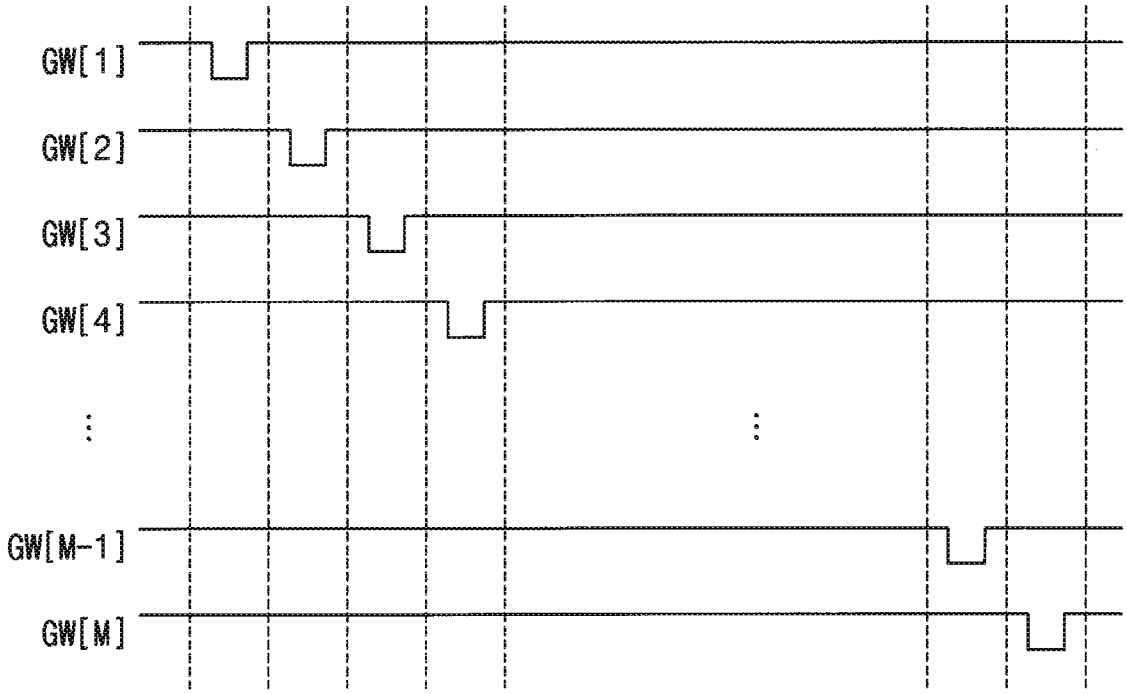
FIG. 8 is a timing diagram illustrating an operation of a gate driver of FIG. 1 in a compensation frame of FIG. 7.
Figure 9:
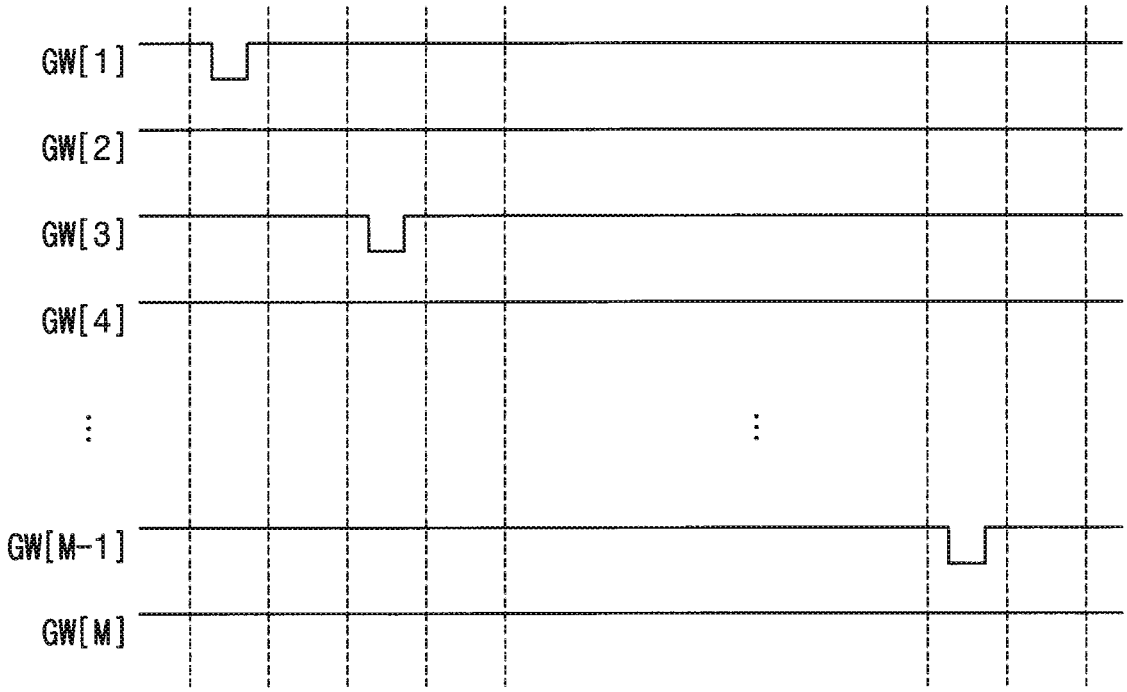
FIG. 9 is a timing diagram illustrating an operation of the gate driver of FIG. 1 in a first duration of an alternate driving mode.
Figure 10:
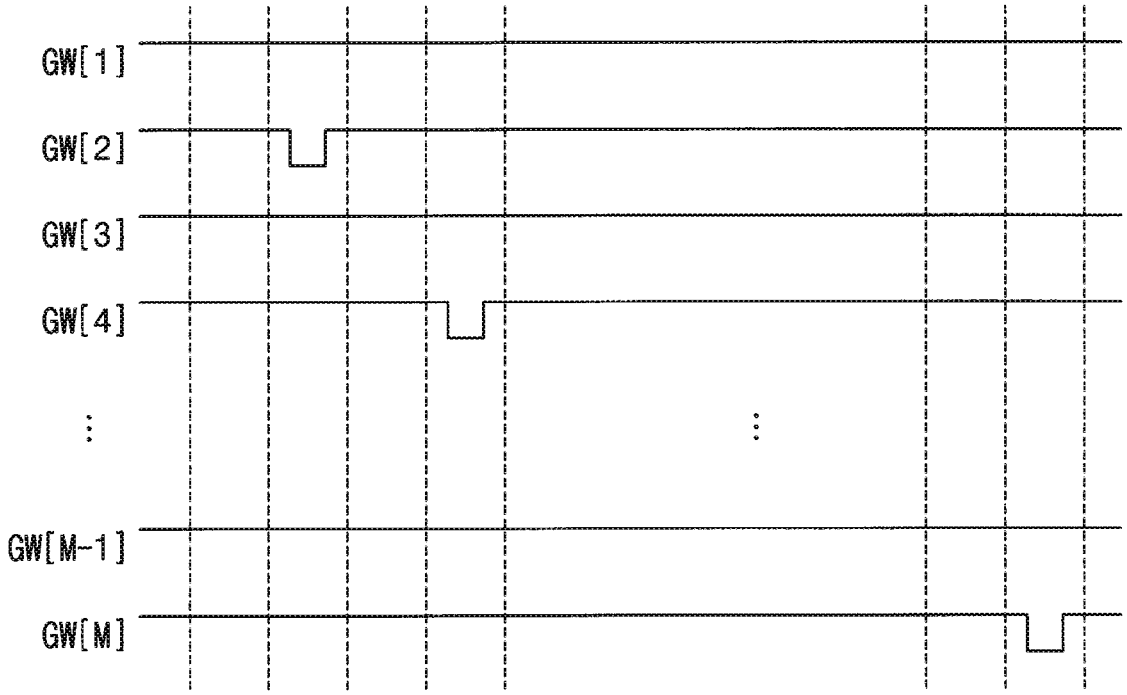
FIG. 10 is a timing diagram illustrating an operation of the gate driver of FIG. 1 in a second duration of the alternate driving mode.

FIG. 6 is a block diagram illustrating the driving controller 200 of FIG. 1. FIG. 7 is a flowchart diagram illustrating an operation of the driving controller 200 of FIG. 1. FIG. 8 is a timing diagram illustrating an operation of the gate driver 300 of FIG. 1 in a compensation frame of FIG. 7. FIG. 9 is a timing diagram illustrating an operation of the gate driver 300 of FIG. 1 in a first duration of an alternate driving mode. FIG. 10 is a timing diagram illustrating an operation of the gate driver 300 of FIG. 1 in a second duration of the alternate driving mode.

Referring to FIGS. 1 to 10, the driving controller 200 may determine the display mode of the display panel whether it is the moving image mode or the static image mode according to the input image data IMG. In the moving image mode, the driving controller 200 may drive the display panel 100 in the moving image driving frequency. In the static image mode, the driving controller 200 may drive the display panel 100 in the static image driving frequency.

For example, in the static image mode, the driving controller 200 may operate the gate driver 300 in an alternate driving mode such that the gate driver 300 scans a first group of the gate lines in a first duration and a second group of the gate lines in a second duration. In addition, when the image transition is occurred in the static image mode, the driving controller 200 may insert a compensation frame to scan all the gate lines.

In contrast, in the moving image mode, the driving controller 200 may operate the gate driver 300 in a normal driving mode such that the gate driver 300 scans all the gate lines.

For example, the driving controller 200 may include a static image determiner 220 determining whether the input image data IMG is the moving image or the static image, a driving frequency determiner 240 determining the moving image driving frequency and the static image driving frequency, a driving mode determiner 260 determining the alternate driving mode and the normal driving mode and a compensation frame inserter 280 inserting the compensation frame.

As shown in FIG. 7, the static image determiner 220 may determine whether the input image data IMG is the static image or the moving image (operation S100). For example, the static image determiner 220 compares images of adjacent frames of the input image data IMG for each frame to determine whether the input image data IMG is the static image or the moving image. For example, the static image determiner 220 may compare images of plural frames to determine whether the input image data IMG is the static image or the moving image.

In the static image mode, the driving frequency determiner 240 may determine the static image driving frequency (operation S200). The driving frequency determiner 240 may determine the static image driving frequency based on a grayscale value of the input image data IMG. The driving frequency determiner 240 may determine the static image driving frequency as 30 Hz, 15 Hz, 10 Hz, 5 Hz, 1 Hz and so on.

The driving mode determiner 260 may determine a driving mode of the display panel whether it is the alternate driving mode or the normal driving mode. For example, the gate driver 300 may operate in the alternate driving mode when the input image data IMG is the static image such that the gate driver 300 scans the first group of the gate lines in the first duration and the second group of the gate lines in the second duration. For example, in the alternate driving mode, a length of the first duration may be substantially the same as a length of the second duration.

When the image transition is occurred in the static image mode, the compensation frame inserter 280 may insert the compensation frame to scan all the gate lines (operation S300). After inserting the compensation frame, the gate driver 300 may operate in the alternate driving mode (operation S400). A length of the compensation frame may be substantially the same as the length of the first duration in the alternate driving mode and the length of the second duration in the alternate driving mode.

In the present example embodiment, the first group of the gate lines may be odd numbered gate lines and the second group of the gate lines may be even numbered gate lines.

For example, when the image transition is occurred in the static image mode, all of the gate lines may be scanned in a first frame. In a second frame, the odd numbered gate lines may be scanned. In a third frame, the even numbered gate lines may be scanned. In a fourth frame, the odd numbered gate lines may be scanned. In a fifth frame, the even numbered gate lines may be scanned.

When the image transition is occurred in the static image mode again, all of the gate lines may be scanned in a first frame of the image transition. In a second frame from the image transition, the odd numbered gate lines may be scanned. In a third frame from the image transition, the even numbered gate lines may be scanned.

In the moving image mode, the driving frequency determiner 240 may determine the moving image driving frequency (operation S500). The moving image driving frequency may be a predetermined fixed frequency. For example, the moving image driving frequency may be substantially the same as an input frequency of the input image data IMG.

In the moving image mode, the driving controller 200 may operate the gate driver 300 in the normal driving mode to scan all of the gate lines (operation S600).

Although only the data write gate signal GW is illustrated among the gate signals for convenience of explanation in FIGS. 8 to 10, the data initialization gate signal GI, the organic light emitting element initialization gate signal and the emission signal EM may have timings corresponding to the data write gate signal GW.

As shown in FIG. 8, all of the gate lines may be scanned by the gate signals GW[1], GW[2], GW[3], GW[4], . . . , GW[M−1] and GW[M] in the compensation frame.

As shown in FIG. 9, the odd numbered gate lines may be scanned by the odd numbered gate signals GW[1], GW[3], . . . , GW[M−1] in the first duration of the alternate driving mode. Herein, M may be an even number.

As shown in FIG. 10, the even numbered gate lines may be scanned by the even numbered gate signals GW[2], GW[4], . . . , GW[M] in the second duration of the alternate driving mode.

In the present example embodiment, a width of a gate pulse in the first duration of the alternate driving mode may be substantially the same as a width of a gate pulse in the compensation frame. In the same manner, a width of a gate pulse in the second duration of the alternate driving mode may be substantially the same as the width of the gate pulse in the compensation frame.

All of the gate lines may be scanned by the gate signals GW[1], GW[2], GW[3], GW[4], . . . , GW[M-1] and GW[M] in the normal driving mode. Thus, the scanning method in the normal driving mode is substantially the same as the scanning method shown in FIG. 8 except for a difference in a scale of a horizontal axis according to the moving image driving frequency and the static image driving frequency.

Figure 11:
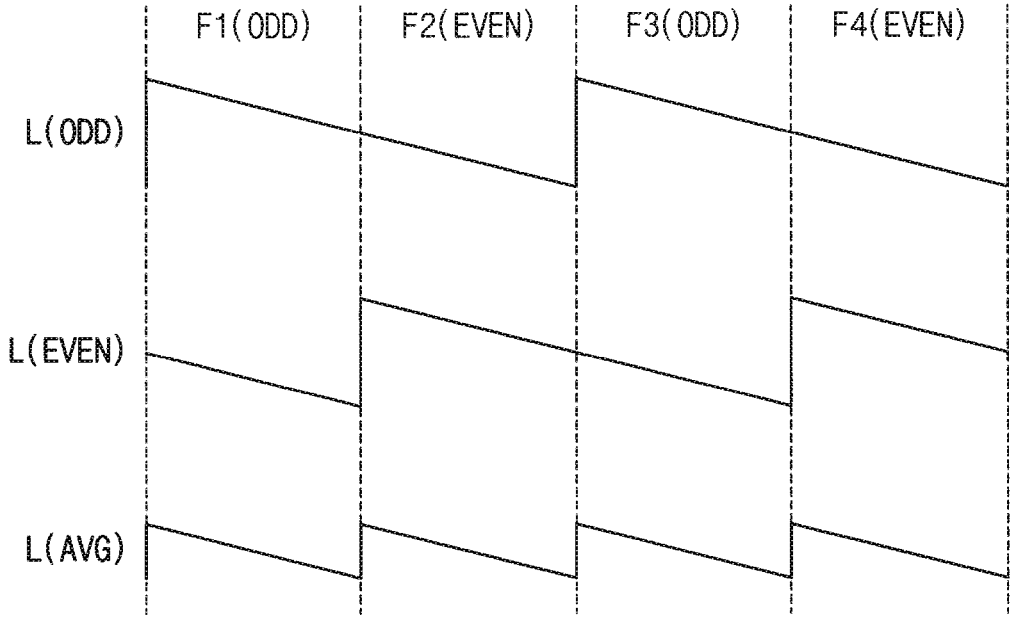
FIG. 11 is a graph illustrating a luminance of the display panel of FIG. 1 in the alternate driving mode.

FIG. 11 is a graph illustrating a luminance of the display panel 100 of FIG. 1 in the alternate driving mode.

Referring to FIGS. 1 to 11, in the alternate driving mode, the odd numbered gate lines are scanned during the first duration (e.g. F1 and F3) so that the threshold voltage compensated data voltages are written in the pixels connected to the odd numbered gate lines. In addition, in the alternate driving mode, the even numbered gate lines are scanned during the second duration (e.g. F2 and F4) so that the threshold voltage compensated data voltages are written in the pixels connected to the even numbered gate lines.

A user may recognize an average luminance L(AVG) of the luminance L(ODD) of the pixels connected to the odd numbered gate lines and the luminance L(EVEN) of the pixels connected to the even numbered gate lines so that the luminance L(AVG) shown to the user may increase in the alternate driving mode compared to the normal driving mode. Thus, the flicker may be prevented in the static image mode (a low frequency driving mode) by driving the display panel in the alternate driving mode.

Figure 12:
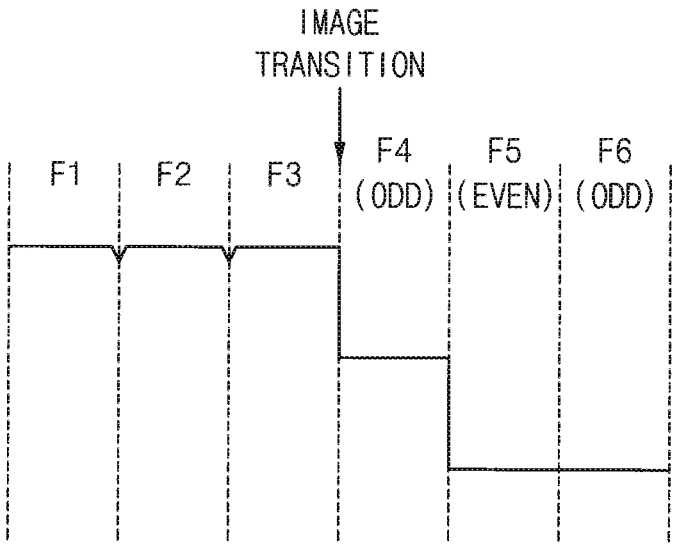
FIG. 12 is a graph illustrating a luminance of the display panel of FIG. 1 when an image transition is occurred in a static image mode and a compensation frame is not inserted.
Figure 13:
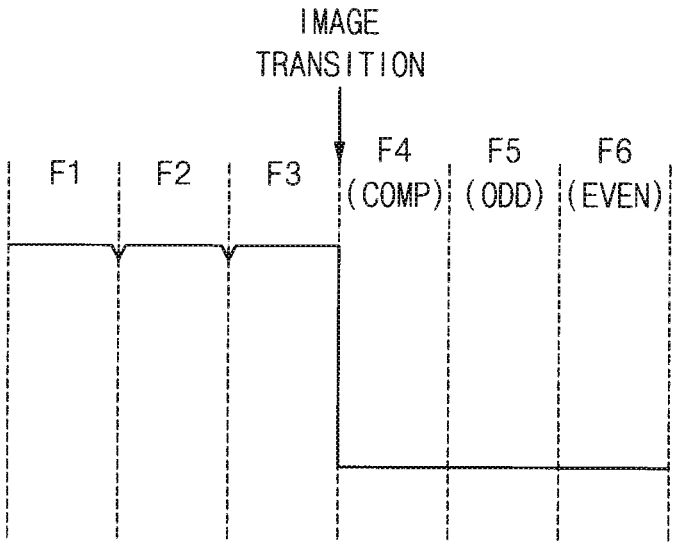
FIG. 13 is a graph illustrating a luminance of the display panel of FIG. 1 when an image transition is occurred in the static image mode and the compensation frame is inserted.

FIG. 12 is a graph illustrating a luminance of the display panel 100 of FIG. 1 when an image transition is occurred in a static image mode and a compensation frame is not inserted. FIG. 13 is a graph illustrating a luminance of the display panel 100 of FIG. 1 when an image transition is occurred in the static image mode and the compensation frame is inserted.

For convenience of explanation, for example, the display panel 100 may operate in the static image mode during F1 duration to F6 duration. The display panel 100 may display a first image during F1 to F3 durations and the display panel 100 may display a second image during F4 to F6 durations.

As shown in FIG. 12, when the image transition is occurred in the static image mode and the compensation frame is not inserted, a changed image may be applied to the pixels connected to the odd numbered gate lines in F4 duration. Thus, the display panel 100 may represent a luminance higher than a desired luminance. When the changed image is applied to the pixels connected to the even numbered gate lines in F5 duration, the display panel 100 may represent the desired luminance. As explained above, when the image transition is occurred in the static image mode and the compensation frame is not inserted, the flicker may be generated by the difference of the luminance of F4 duration and the luminance of F5 duration.

As shown in FIG. 13, when the image transition is occurred in the static image mode and the compensation frame is inserted, the display panel 100 may represent the desired luminance in F4 duration. In F5 duration, the image is applied only to the pixels connected to the odd numbered gate lines. In F6 duration, the image is applied only to the pixels connected to the even numbered gate lines. Thus, the power consumption may be properly reduced. As explained above, when the image transition is occurred in the static image mode and the compensation frame is inserted, the flicker may be prevented. From the second frame after the image transition, the display panel is operated in the alternate driving mode so that the flicker may be prevented and the power consumption may be reduced.

According to the present example embodiment, the driving controller 200 drives the display panel in the moving image driving frequency in the moving image mode, and the driving controller 200 drives the display panel in the static image driving frequency in the static image mode. Thus, the power consumption of the display apparatus may be reduced.

In addition, in the static image mode, the driving controller 200 may operate the gate driver 300 in the alternate driving mode such that the gate driver 300 scans the first group of the gate lines in a first duration and the second group of the gate lines in a second duration. Thus, the flicker due to a current leakage of the pixel may be prevented. In addition, when the image transition is occurred in the static image mode, the driving controller 200 may insert the compensation frame to scan all the gate lines so that the flicker due to the luminance difference between the first frame and the second frame after the image transition in the static mode may be prevented. Thus, the display quality of the display panel may be enhanced.

Figure 14:
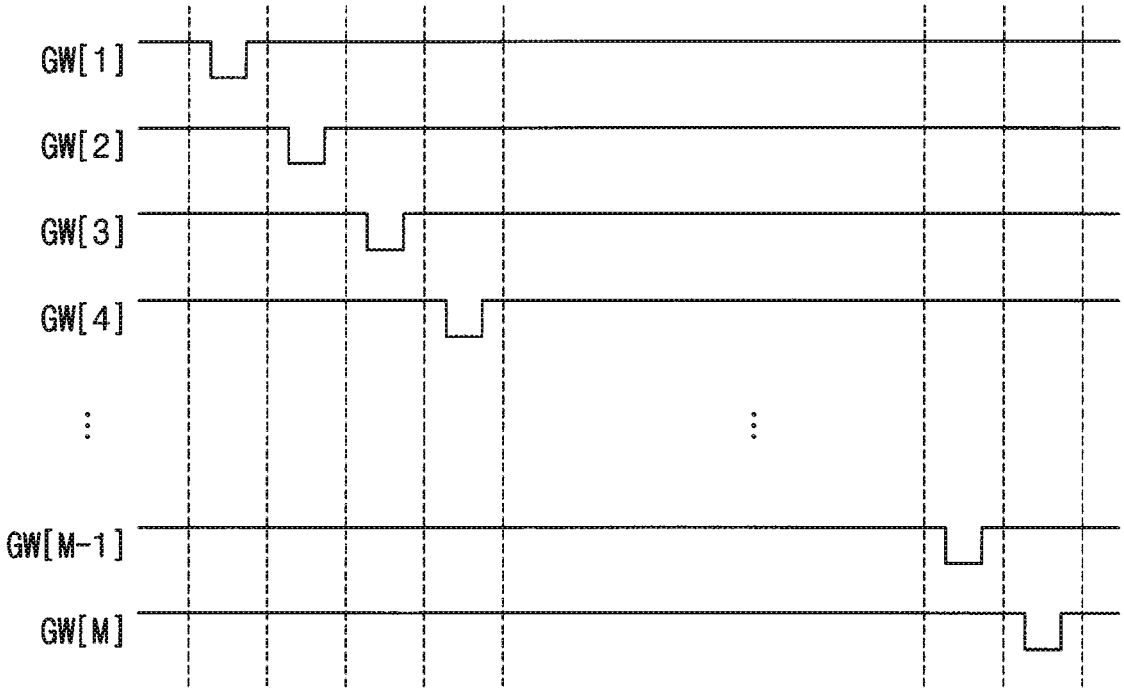
FIG. 14 is a timing diagram illustrating an operation of a gate driver of a display apparatus according to an example embodiment of the present inventive concept in a compensation frame.
Figure 15:
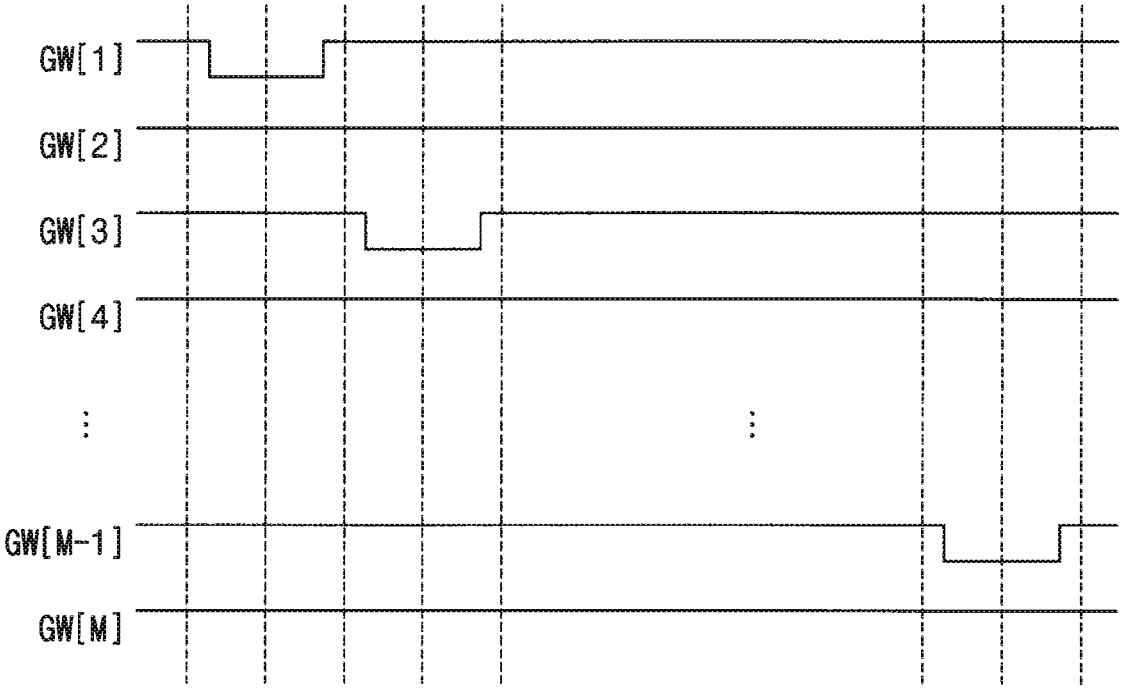
FIG. 15 is a timing diagram illustrating an operation of the gate driver of FIG. 14 in a first duration of an alternate driving mode.
Figure 16:
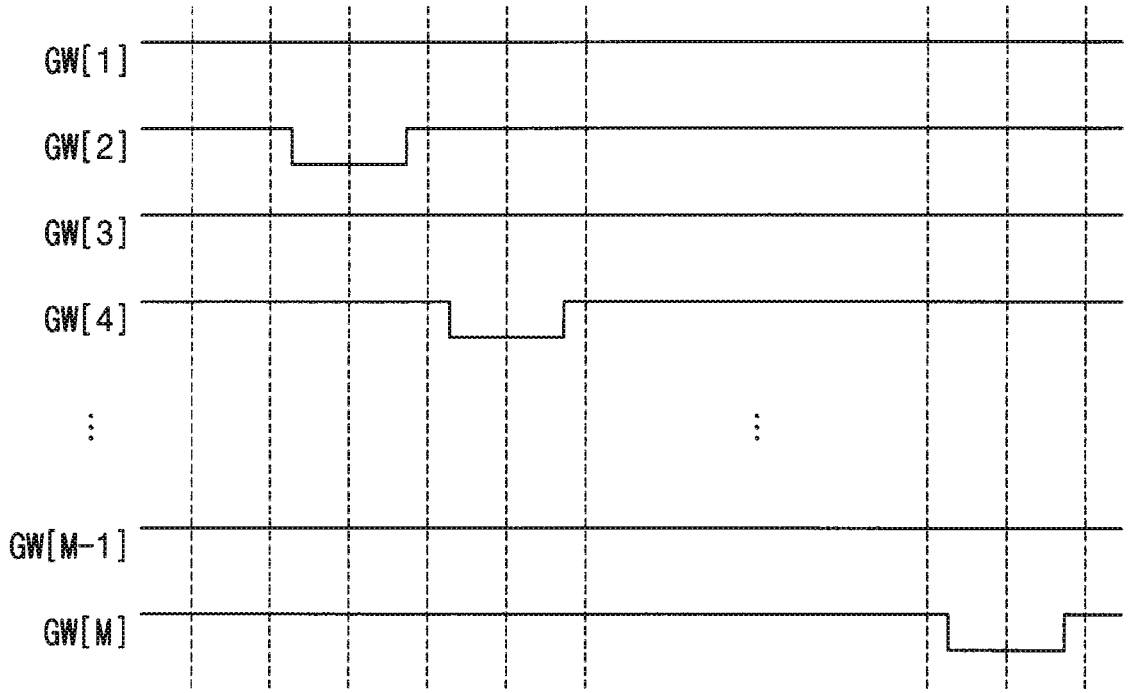
FIG. 16 is a timing diagram illustrating an operation of the gate driver of FIG. 14 in a second duration of the alternate driving mode.

FIG. 14 is a timing diagram illustrating an operation of a gate driver of a display apparatus according to an example embodiment of the present inventive concept in a compensation frame. FIG. 15 is a timing diagram illustrating an operation of the gate driver of FIG. 14 in a first duration of an alternate driving mode. FIG. 16 is a timing diagram illustrating an operation of the gate driver of FIG. 14 in a second duration of the alternate driving mode.

The display apparatus and the method of driving the display apparatus according to the present example embodiment is substantially the same as the display apparatus and the method of driving the display apparatus of the previous example embodiment explained referring to FIGS. 1 to 13 except for the waveform of the gate signal in the alternate driving mode. Thus, the same reference numerals will be used to refer to the same or like parts as those described in the previous example embodiment of FIGS. 1 to 13 and any repetitive explanation concerning the above elements will be omitted.

Referring to FIGS. 1 to 7 and 11 to 16, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 may determine the display mode of the display panel whether it is a moving image mode or a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, in the static image mode, the driving controller 200 may operate the gate driver 300 in an alternate driving mode such that the gate driver 300 scans a first group of the gate lines in a first duration and a second group of the gate lines in a second duration. In addition, when the image transition is occurred in the static image mode, the driving controller 200 may insert a compensation frame to scan all the gate lines.

Although only the data write gate signal GW is illustrated among the gate signals for convenience of explanation in FIGS. 14 to 16, the data initialization gate signal GI, the organic light emitting element initialization gate signal and the emission signal EM may have timings corresponding to the data write gate signal GW.

As shown in FIG. 14, all of the gate lines may be scanned by the gate signals GW[1], GW[2], GW[3], GW[4], . . . , GW[M−1] and GW[M] in the compensation frame.

As shown in FIG. 15, the odd numbered gate lines may be scanned by the odd numbered gate signals GW[1], GW[3], . . . , GW[M−1] in the first duration of the alternate driving mode. Herein, M may be an even number.

As shown in FIG. 16, the even numbered gate lines may be scanned by the even numbered gate signals GW[2], GW[4], . . . , GW[M] in the second duration of the alternate driving mode.

In the present example embodiment, a width of a gate pulse in the first duration of the alternate driving mode may be greater than a width of a gate pulse in the compensation frame. For example, the width of the gate pulse in the first duration of the alternate driving mode may be equal to or greater than twice the width of the gate pulse in the compensation frame. In the same manner, a width of a gate pulse in the second duration of the alternate driving mode may be greater than the width of the gate pulse in the compensation frame. For example, the width of the gate pulse in the second duration of the alternate driving mode may be equal to or greater than twice the width of the gate pulse in the compensation frame.

All of the gate lines are scanned in the compensation frame. However, only half of the gate lines are scanned in each of the first duration and the second duration of the alternate driving mode so that the width of the gate pulse may be increased in the alternate driving mode to increase a charging time of the pixel.

According to the present example embodiment, the driving controller 200 drives the display panel in the moving image driving frequency in the moving image mode, and the driving controller 200 drives the display panel in the static image driving frequency in the static image mode. Thus, the power consumption of the display apparatus may be reduced.

In addition, in the static image mode, the driving controller 200 may operate the gate driver 300 in the alternate driving mode such that the gate driver 300 scans the first group of the gate lines in a first duration and the second group of the gate lines in a second duration. Thus, the flicker due to a current leakage of the pixel may be prevented. In addition, when the image transition is occurred in the static image mode, the driving controller 200 may insert the compensation frame to scan all the gate lines so that the flicker due to the luminance difference between the first frame and the second frame after the image transition in the static mode may be prevented. Thus, the display quality of the display panel may be enhanced.

Figure 17:
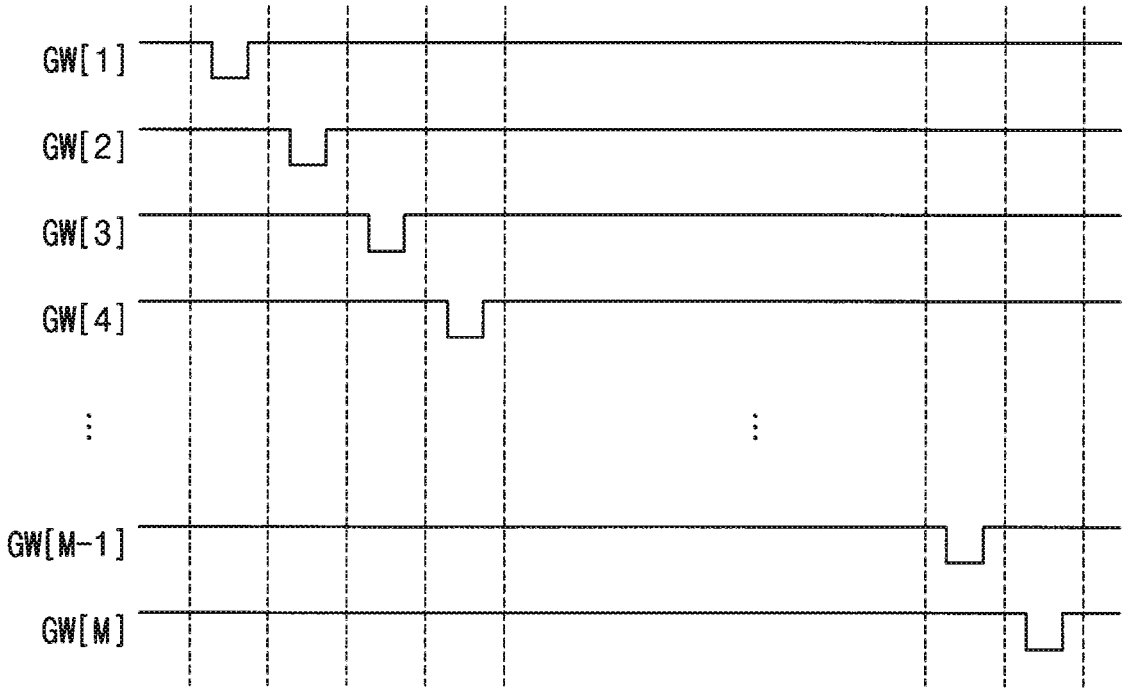
FIG. 17 is a timing diagram illustrating an operation of a gate driver of a display apparatus according to an example embodiment of the present inventive concept in a compensation frame.
Figure 18:
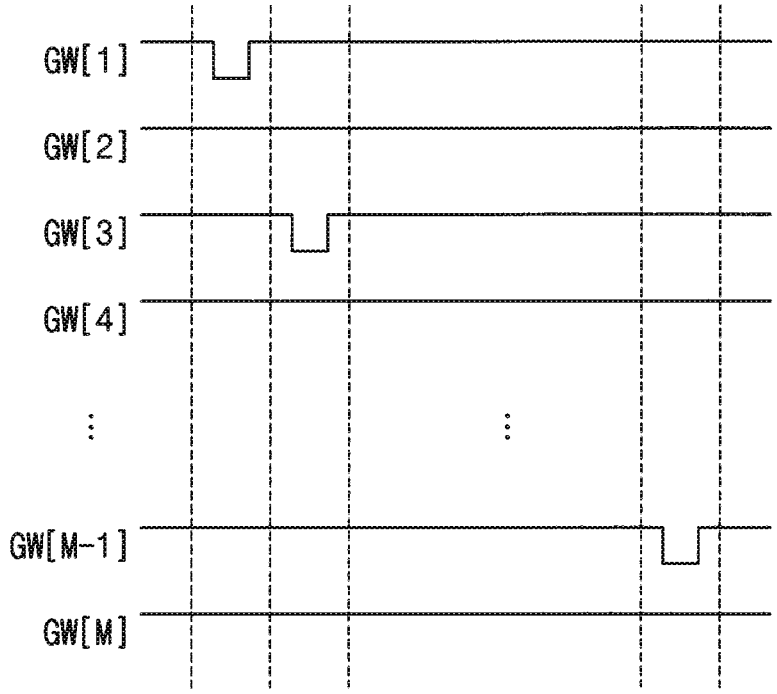
FIG. 18 is a timing diagram illustrating an operation of the gate driver of FIG. 17 in a first duration of an alternate driving mode.
Figure 19:
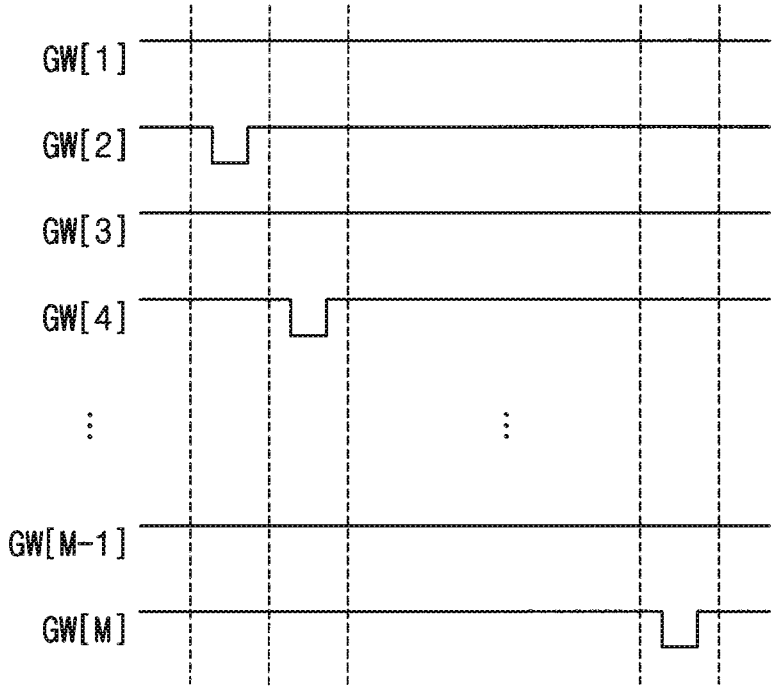
FIG. 19 is a timing diagram illustrating an operation of the gate driver of FIG. 17 in a second duration of the alternate driving mode.

FIG. 17 is a timing diagram illustrating an operation of a gate driver of a display apparatus according to an example embodiment of the present inventive concept in a compensation frame. FIG. 18 is a timing diagram illustrating an operation of the gate driver of FIG. 17 in a first duration of an alternate driving mode. FIG. 19 is a timing diagram illustrating an operation of the gate driver of FIG. 17 in a second duration of the alternate driving mode.

The display apparatus and the method of driving the display apparatus according to the present example embodiment is substantially the same as the display apparatus and the method of driving the display apparatus of the previous example embodiment explained referring to FIGS. 1 to 13 except for the waveform of the gate signal in the alternate driving mode. Thus, the same reference numerals will be used to refer to the same or like parts as those described in the previous example embodiment of FIGS. 1 to 13 and any repetitive explanation concerning the above elements will be omitted.

Referring to FIGS. 1 to 7, 11 to 13 and 17 to 19, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 may determine the display mode of the display panel whether it is a moving image mode or a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, in the static image mode, the driving controller 200 may operate the gate driver 300 in an alternate driving mode such that the gate driver 300 scans a first group of the gate lines in a first duration and a second group of the gate lines in a second duration. In addition, when the image transition is occurred in the static image mode, the driving controller 200 may insert a compensation frame to scan all the gate lines.

Although only the data write gate signal GW is illustrated among the gate signals for convenience of explanation in FIGS. 17 to 19, the data initialization gate signal GI, the organic light emitting element initialization gate signal and the emission signal EM may have timings corresponding to the data write gate signal GW.

As shown in FIG. 17, all of the gate lines may be scanned by the gate signals GW[1], GW[2], GW[3], GW[4], . . . , GW[M−1] and GW[M] in the compensation frame.

As shown in FIG. 18, the odd numbered gate lines may be scanned by the odd numbered gate signals GW[1], GW[3], . . . , GW[M−1] in the first duration of the alternate driving mode. Herein, M may be an even number. In the present example embodiment, a pulse of the third gate signal GW[3] may be positioned in an immediately next horizontal period of a pulse of the first gate signal GW[1] unlike FIG. 9.

As shown in FIG. 19, the even numbered gate lines may be scanned by the even numbered gate signals GW[2], GW[4], . . . , GW[M] in the second duration of the alternate driving mode. In the present example embodiment, a pulse of the fourth gate signal GW[4] may be positioned in an immediately next horizontal period of a pulse of the second gate signal GW[2] unlike FIG. 10.

In the present example embodiment, a width of a gate pulse in the first duration of the alternate driving mode may be substantially the same as a width of a gate pulse in the compensation frame. In the same manner, a width of a gate pulse in the second duration of the alternate driving mode may be substantially the same as the width of the gate pulse in the compensation frame.

According to the present example embodiment, the driving controller 200 drives the display panel in the moving image driving frequency in the moving image mode, and the driving controller 200 drives the display panel in the static image driving frequency in the static image mode. Thus, the power consumption of the display apparatus may be reduced.

In addition, in the static image mode, the driving controller 200 may operate the gate driver 300 in the alternate driving mode such that the gate driver 300 scans the first group of the gate lines in a first duration and the second group of the gate lines in a second duration. Thus, the flicker due to a current leakage of the pixel may be prevented. In addition, when the image transition is occurred in the static image mode, the driving controller 200 may insert the compensation frame to scan all the gate lines so that the flicker due to the luminance difference between the first frame and the second frame after the image transition in the static mode may be prevented. Thus, the display quality of the display panel may be enhanced.

Figure 20:
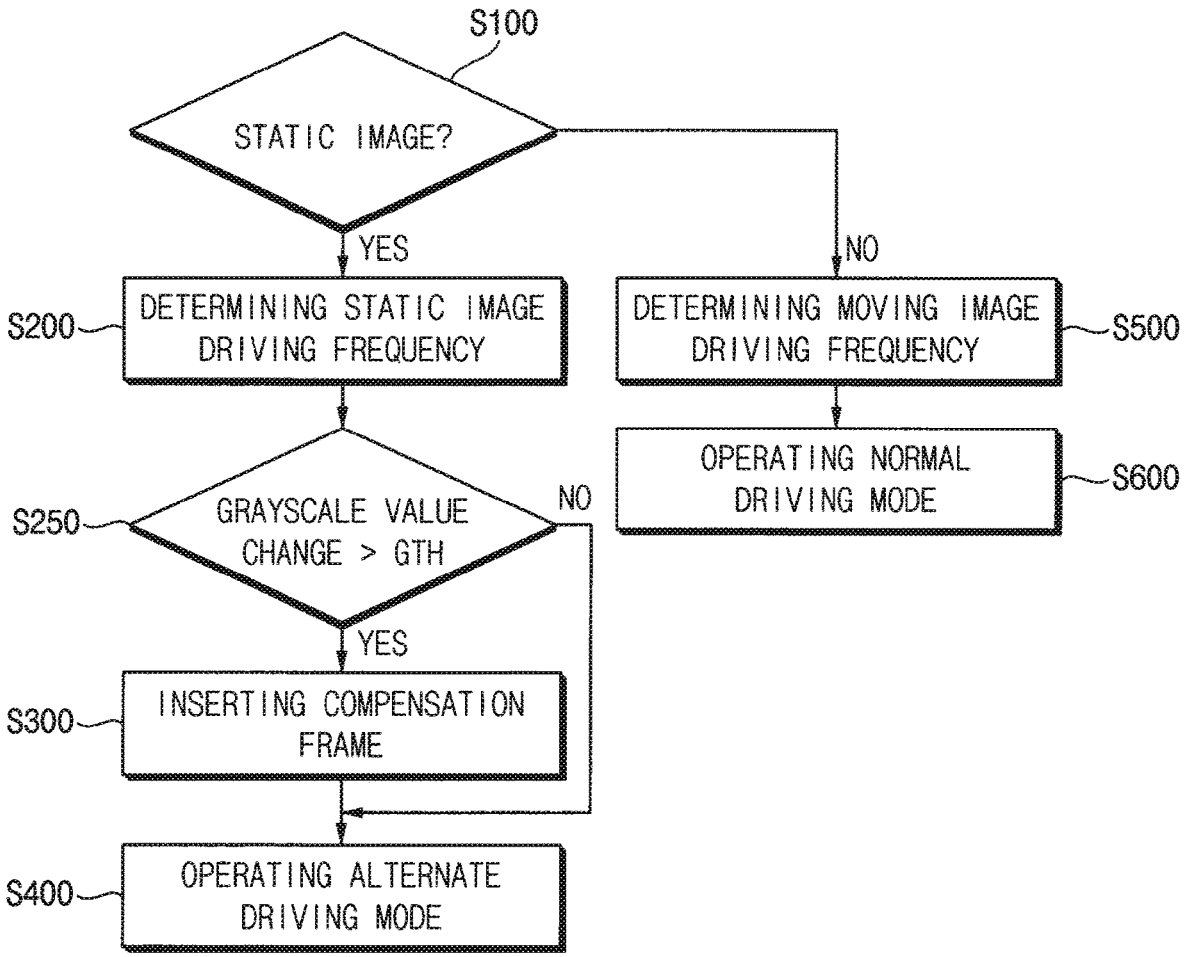
FIG. 20 is a flowchart diagram illustrating an operation of a driving controller of a display apparatus according to an example embodiment of the present inventive concept.

FIG. 20 is a flowchart diagram illustrating an operation of a driving controller of a display apparatus according to an example embodiment of the present inventive concept.

The display apparatus and the method of driving the display apparatus according to the present example embodiment is substantially the same as the display apparatus and the method of driving the display apparatus of the previous example embodiment explained referring to FIGS. 1 to 13 except for the operation of the driving controller. Thus, the same reference numerals will be used to refer to the same or like parts as those described in the previous example embodiment of FIGS. 1 to 13 and any repetitive explanation concerning the above elements will be omitted.

Referring to FIGS. 1 to 6, 8 to 13 and 20, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 may determine the display mode of the display panel whether it is a moving image mode or a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, in the static image mode, the driving controller 200 may operate the gate driver 300 in an alternate driving mode such that the gate driver 300 scans a first group of the gate lines in a first duration and a second group of the gate lines in a second duration. In addition, when the image transition is occurred in the static image mode, the driving controller 200 may insert a compensation frame to scan all the gate lines.

In contrast, in the moving image mode, the driving controller 200 may operate the gate driver 300 in a normal driving mode such that the gate driver 300 scans all the gate lines.

For example, the driving controller 200 may include a static image determiner 220 determining whether the input image data IMG is the moving image or the static image, a driving frequency determiner 240 determining the moving image driving frequency and the static image driving frequency, a driving mode determiner 260 determining a driving mode of the display panel whether the driving mode is the alternate driving mode or the normal driving mode and a compensation frame inserter 280 inserting the compensation frame.

In the present example embodiment, when the image transition is occurred in the static image mode, the compensation frame inserter 280 may compare a difference of a grayscale value of a previous image and a grayscale value of a present image to a grayscale threshold GTH (operation S250). When the difference of the grayscale value of the previous image and the grayscale value of the present image is greater than the grayscale threshold GTH, the compensation frame inserter 280 may insert the compensation frame (step S300).

When the difference of the grayscale value of the previous image and the grayscale value of the present image is equal to or less than the grayscale threshold GTH, the compensation frame may not be inserted and the display panel may be operated in the alternate driving mode (step S400). When the difference of the grayscale value of the previous image and the grayscale value of the present image is small, a problem of not displaying the desired luminance in the first frame after the image transition is not serious so that the flicker due to the difference of the luminance of the first frame and the luminance of the second frame after the image transition may not be generated.

Thus, when the difference of the grayscale value of the previous image and the grayscale value of the present image is small, the compensation frame is not inserted but the alternate driving mode is immediately operated after the image transition so that the power consumption may be further reduced.

According to the present example embodiment, the driving controller 200 drives the display panel in the moving image driving frequency in the moving image mode, and the driving controller 200 drives the display panel in the static image driving frequency in the static image mode. Thus, the power consumption of the display apparatus may be reduced.

In addition, in the static image mode, the driving controller 200 may operate the gate driver 300 in the alternate driving mode such that the gate driver 300 scans the first group of the gate lines in a first duration and the second group of the gate lines in a second duration. Thus, the flicker due to a current leakage of the pixel may be prevented. In addition, when the image transition is occurred in the static image mode, the driving controller 200 may insert the compensation frame to scan all the gate lines so that the flicker due to the luminance difference between the first frame and the second frame after the image transition in the static mode may be prevented. Thus, the display quality of the display panel may be enhanced.

Figure 21:
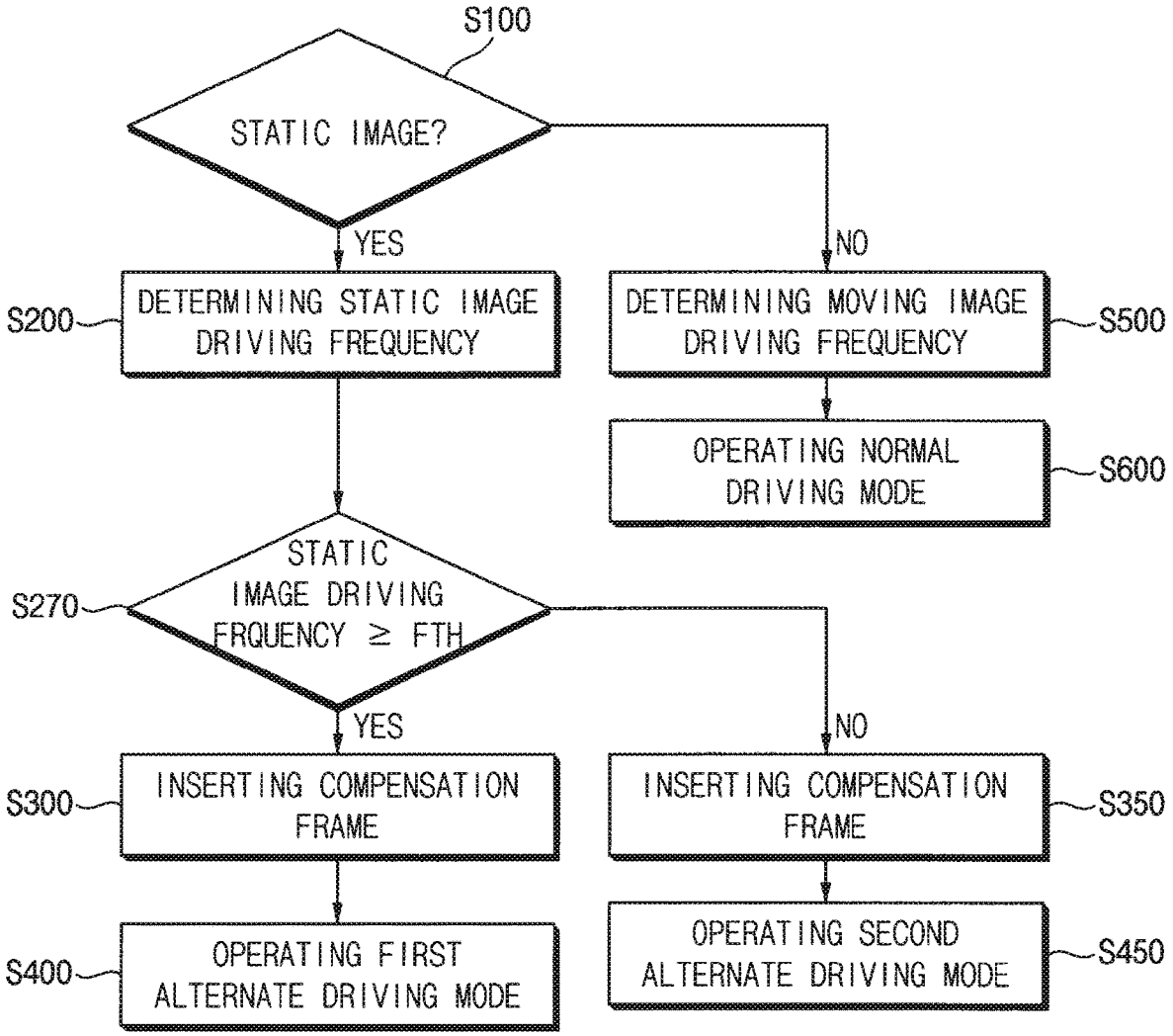
FIG. 21 is a flowchart diagram illustrating an operation of a driving controller of a display apparatus according to an example embodiment of the present inventive concept.
Figure 22:
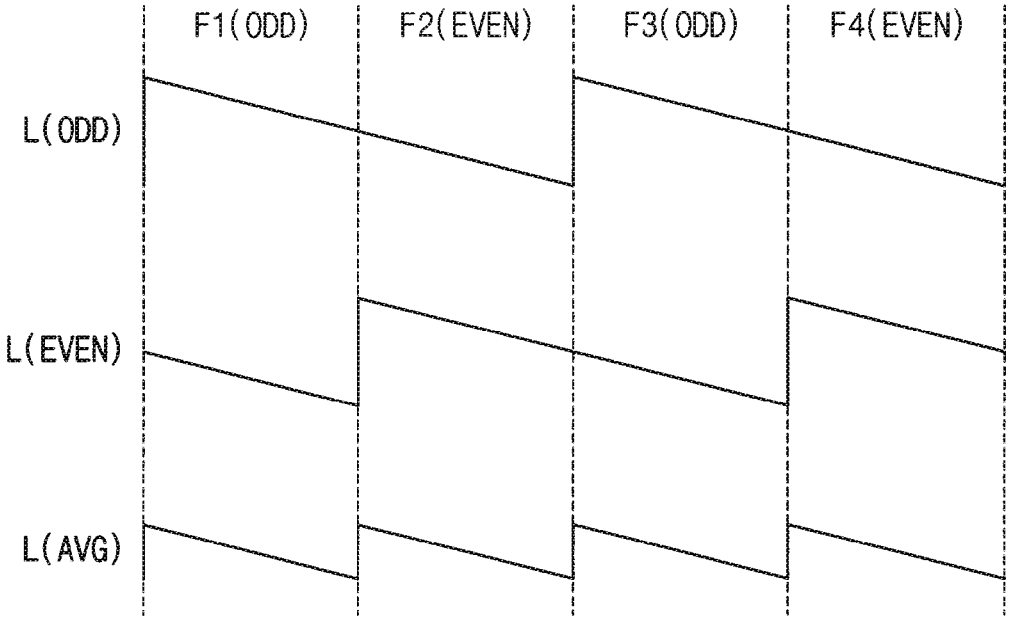
FIG. 22 is a graph illustrating a luminance of a display panel of the display apparatus of FIG. 21 in a first alternate driving mode.
Figure 23:
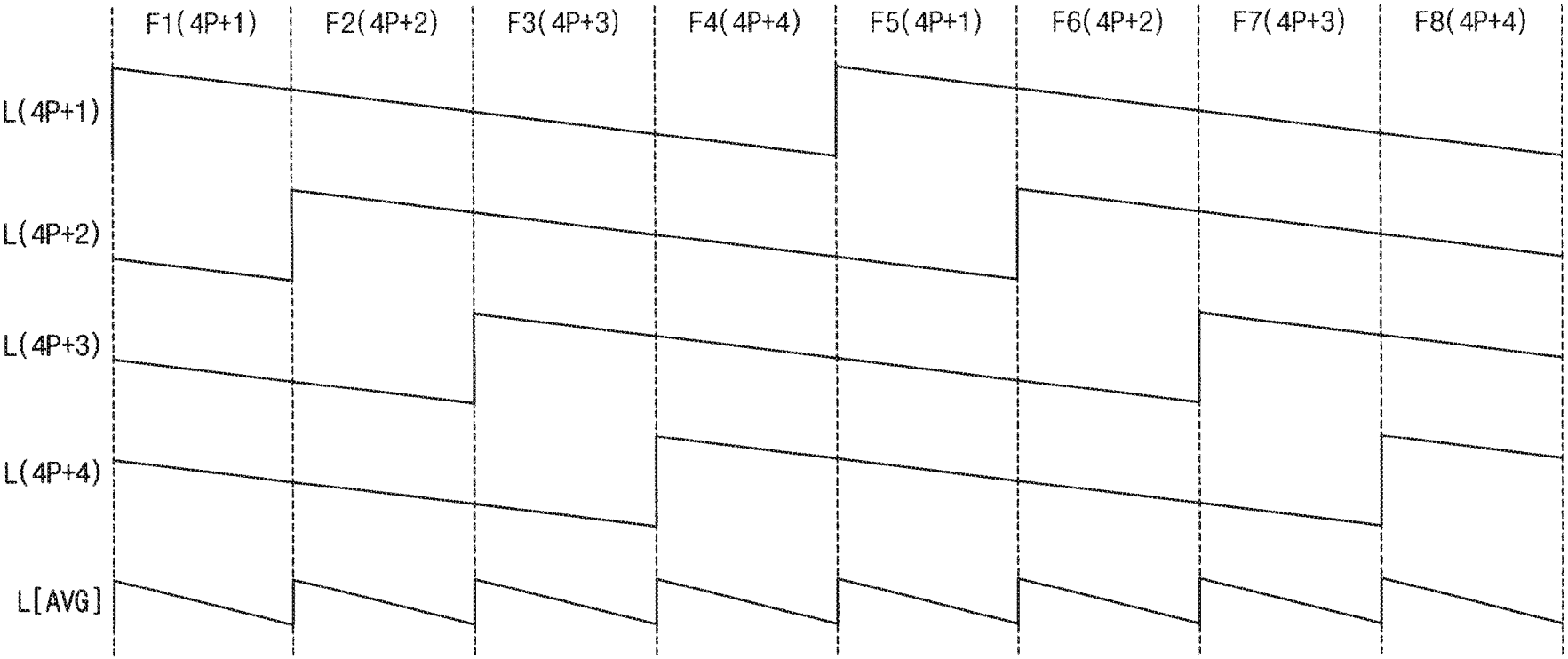
FIG. 23 is a graph illustrating a luminance of the display panel of the display apparatus of FIG. 21 in a second alternate driving mode.

FIG. 21 is a flowchart diagram illustrating an operation of a driving controller 200 of a display apparatus according to an example embodiment of the present inventive concept. FIG. 22 is a graph illustrating a luminance of a display panel 100 of the display apparatus of FIG. 21 in a first alternate driving mode. FIG. 23 is a graph illustrating a luminance of the display panel 100 of the display apparatus of FIG. 21 in a second alternate driving mode.

The display apparatus and the method of driving the display apparatus according to the present example embodiment is substantially the same as the display apparatus and the method of driving the display apparatus of the previous example embodiment explained referring to FIGS. 1 to 13 except for the operation of the driving controller. Thus, the same reference numerals will be used to refer to the same or like parts as those described in the previous example embodiment of FIGS. 1 to 13 and any repetitive explanation concerning the above elements will be omitted.

Referring to FIGS. 1 to 6, 8 to 13 and 21 to 23, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 may determine the display mode of the display panel whether it is a moving image mode or a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, in the static image mode, the driving controller 200 may operate the gate driver 300 in an alternate driving mode such that the gate driver 300 scans a first group of the gate lines in a first duration and a second group of the gate lines in a second duration. In addition, when the image transition is occurred in the static image mode, the driving controller 200 may insert a compensation frame to scan all the gate lines.

In contrast, in the moving image mode, the driving controller 200 may operate the gate driver 300 in a normal driving mode such that the gate driver 300 scans all the gate lines.

For example, the driving controller 200 may include a static image determiner 220 determining whether the input image data IMG is the moving image mode or the static image mode, a driving frequency determiner 240 determining the moving image driving frequency and the static image driving frequency, a driving mode determiner 260 determining a driving mode of the display panel whether it is the alternate driving mode and the normal driving mode, and a compensation frame inserter 280 inserting the compensation frame.

In the present example embodiment, the driving mode determiner 260 may determine the alternate driving mode to one of a first alternate driving mode and a second alternate driving mode according to the static image driving frequency. Although not shown in figures, the driving mode determiner 260 may determine the alternate driving mode to one of three or more different alternate driving modes.

When the static image driving frequency is equal to or greater than a frequency threshold FTH (operation S270), the gate driver 300 may operate in a first alternate driving mode (operation S400). When the static image driving frequency is less than the frequency threshold FTH (operation S270), the gate driver 300 may operate in a second alternate driving mode (operation S450). The frequency threshold FTH may be decided as a half of the input frequency of the input image data IMG. For example, when the input frequency of the input image data IMG is 60 Hz, the frequency threshold FTH may be 30 Hz. For example, when the input frequency of the input image data IMG is 120 Hz, the frequency threshold FTH may be 60 Hz.

When the alternate driving mode is determined as the first alternate driving mode and the image transition is occurred in the static image mode, the compensation frame inserter 280 may insert the compensation frame to scan all of the gate lines (operation S300). Similarly, when the alternate driving mode is determined as the second alternate driving mode and the image transition is occurred in the static image mode, the compensation frame inserter 280 may also insert the compensation frame to scan all of the gate lines (operation S350).

In the first alternate driving mode, the first group of the gate lines may be odd numbered gate lines and the second group of the gate lines may be even numbered gate lines.

As shown in FIG. 22, in the first alternate driving mode, the odd numbered gate lines are scanned during the first duration (e.g. F1 and F3) so that the threshold voltage compensated data voltages are written in the pixels connected to the odd numbered gate lines. In addition, in the alternate driving mode, the even numbered gate lines are scanned during the second duration (e.g. F2 and F4) so that the threshold voltage compensated data voltages are written in the pixels connected to the even numbered gate lines.

A user may recognize an average luminance L(AVG) of the luminance L(ODD) of the pixels connected to the odd numbered gate lines and the luminance L(EVEN) of the pixels connected to the even numbered gate lines so that the luminance L(AVG) shown to the user may increase in the first alternate driving mode compared to the normal driving mode. Thus, the flicker may be prevented in the static image mode (a low frequency driving mode) by the first alternate driving mode method.

In the second alternate driving mode, the display panel 100 may include a first group of gate lines, a second group of gate lines, a third group of gate lines and a fourth group of gate lines. In the second alternate driving mode, the first group of the gate lines may be (4P+1)-th gate lines, the second group of the gate lines may be (4P+2)-th gate lines, the third group of the gate lines may be (4P+3)-th gate lines and the fourth group of the gate lines may be (4P+4)-th gate lines. Herein, P may be an integer equal to or greater than zero.

As shown in FIG. 23, in the second alternate driving mode, the (4P+1)-th gate lines are scanned during the first duration (e.g. F1 and F5) so that the threshold voltage compensated data voltages are written in the pixels connected to the (4P+1)-th gate lines. In addition, in the second alternate driving mode, the (4P+2)-th gate lines are scanned during the second duration (e.g. F2 and F6) so that the threshold voltage compensated data voltages are written in the pixels connected to the (4P+2)-th gate lines. In addition, in the second alternate driving mode, the (4P+3)-th gate lines are scanned during the third duration (e.g. F3 and F7) so that the threshold voltage compensated data voltages are written in the pixels connected to the (4P+3)-th gate lines. In addition, in the second alternate driving mode, the (4P+4)-th gate lines are scanned during the fourth duration (e.g. F4 and F8) so that the threshold voltage compensated data voltages are written in the pixels connected to the (4P+4)-th gate lines.

A user may recognize an average luminance L(AVG) of the luminance L(4P+1) of the pixels connected to the (4P+1)-th gate lines, the luminance L(4P+2) of the pixels connected to the (4P+2)-th gate lines, the luminance L(4P+3) of the pixels connected to the (4P+3)-th gate lines and the luminance L(4P+4) of the pixels connected to the (4P+4)-th gate lines so that the luminance L(AVG) shown to the user may increase in the second alternate driving mode compared to the normal driving mode and the first alternate driving mode. Thus, the flicker may be prevented in the static image mode (a low frequency driving mode) by the second alternate driving mode method.

According to the present example embodiment, the driving controller 200 drives the display panel in the moving image driving frequency in the moving image mode, and the driving controller 200 drives the display panel in the static image driving frequency in the static image mode. Thus, the power consumption of the display apparatus may be reduced.

In addition, in the static image mode, the driving controller 200 may operate the gate driver 300 in the alternate driving mode such that the gate driver 300 scans the first group of the gate lines in a first duration and the second group of the gate lines in a second duration. Thus, the flicker due to a current leakage of the pixel may be prevented. In addition, when the image transition is occurred in the static image mode, the driving controller 200 may insert the compensation frame to scan all the gate lines so that the flicker due to the luminance difference between the first frame and the second frame after the image transition in the static mode may be prevented. Thus, the display quality of the display panel may be enhanced.

According to the present inventive concept as explained above, the power consumption may be reduced by the low frequency driving method and the display quality of the display panel may be enhanced by preventing the flicker.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A display apparatus comprising:

a display panel comprising a plurality of pixels and configured to display an image based on input image data;

a gate driver configured to apply a gate signal to a gate line of the display panel;

a data driver configured to apply a data voltage to a data line of the display panel; and a driving controller configured to determine a mode of the input image data to a moving image mode or a static image mode according to whether the input image data is a moving image or a static image, wherein the driving controller is configured to drive the display panel in a moving image driving frequency in the moving image mode and configured to drive the display panel in a static image driving frequency in the static image mode, wherein the driving controller is configured to operate the gate driver in an alternate driving mode in the static image mode such that the gate driver scans a first group of the gate lines in a first duration and a second group of the gate lines in a second duration, and wherein, when an image transition is occurred in the static image mode, the driving controller is configured to insert a compensation frame to scan all of the gate lines.

2. The display apparatus of claim 1, wherein a length of the first duration of the alternate driving mode is substantially the same as a length of the second duration of the alternate driving mode.

3. The display apparatus of claim 2, wherein a length of the compensation frame is substantially the same as the length of the first duration of the alternate driving mode and the length of the second duration of the alternate driving mode.

4. The display apparatus of claim 1, wherein the first group of the gate lines are odd numbered gate lines, and wherein the second group of the gate lines are even numbered gate lines.

5. The display apparatus of claim 4, wherein a width of a gate pulse in the first duration of the alternate driving mode is substantially the same as a width of a gate pulse in the compensation frame.

6. The display apparatus of claim 4, wherein a width of a gate pulse in the first duration of the alternate driving mode is equal to or greater than twice a width of a gate pulse in the compensation frame.

7. The display apparatus of claim 1, wherein in the moving image mode, the driving controller is configured to operate the gate driver in a normal driving mode such that the gate driver scans all of the gate lines.

8. The display apparatus of claim 7, wherein the driving controller comprises:

a static image determiner configured to determine whether the input image is the moving image or the static image;

a driving frequency determiner configured to determine the moving image driving frequency and the static image driving frequency;

a driving mode determiner configured to determine a driving mode of the display panel whether the driving mode is the alternate driving mode or the normal driving mode; and a compensation frame inserter configured to insert the compensation frame.

9. The display apparatus of claim 8, wherein, when the image transition is occurred in the static image mode, the compensation frame inserter is configured to compare a difference of a grayscale value of a previous image and a grayscale value of a present image to a grayscale threshold, and wherein, when the difference of the grayscale value of the previous image and the grayscale value of the present image is greater than the grayscale threshold, the compensation frame inserter is configured to insert the compensation frame.

10. The display apparatus of claim 8, wherein, when the static image driving frequency is equal to or greater than a frequency threshold, the driving mode determiner is configured to operate the gate driver in a first alternate driving mode, and wherein, when the static image driving frequency is less than the frequency threshold, the driving mode determiner is configured to operate the gate driver in a second alternate driving mode.

11. The display apparatus of claim 10, wherein the first group of the gate lines are odd numbered gate lines and the second group of the gate lines are even numbered gate lines in the first alternate driving mode.

12. The display apparatus of claim 11, wherein, in the second alternate driving mode, the gate driver scans one fourth of the gate lines in each of a first duration, a second duration, a third duration and a fourth duration.

13. The display apparatus of claim 1, wherein at least one of the pixels comprises:

a first pixel switching element including a control electrode connected to a first node, an input electrode connected to a second node and an output electrode connected to a third node;

a second pixel switching element including a control electrode to which a data write gate signal is applied, an input electrode to which the data voltage is applied and an output electrode connected to the second node;

a third pixel switching element including a control electrode to which the data write gate signal is applied, an input electrode connected to the first node and an output electrode connected to the third node;

a fourth pixel switching element including a control electrode to which a data initialization gate signal is applied, an input electrode to which the initialization voltage is applied and an output electrode connected to the first node;

a fifth pixel switching element including a control electrode to which the emission signal is applied, an input electrode to which a high power voltage is applied and an output electrode connected to the second node;

a sixth pixel switching element including a control electrode to which the emission signal is applied, an input electrode connected to the third node and an output electrode connected to an anode electrode of an organic light emitting element;

a seventh pixel switching element including a control electrode to which the data initialization gate signal is applied, an input electrode to which an initialization voltage is applied and an output electrode connected to the anode electrode of the organic light emitting element; and a storage capacitor including a first electrode to which the high power voltage is applied and a second electrode connected to the first node, and wherein the organic light emitting element including the anode electrode connected to the output electrode of the sixth pixel switching element and a cathode electrode to which a low power voltage is applied.

14. A method of driving a display apparatus, the method comprising:

determining whether input image data is a moving image or a static image;

determining a moving image driving frequency of a moving image mode and a static image driving frequency of a static image mode;

operating a gate driver in an alternate driving mode in the static image mode such that the gate driver exclusively scans a first group of gate lines in a first duration and a second group of gate lines in a second duration; and inserting a compensation frame to scan all of the gate lines when an image transition is occurred in the static image mode.

15. The method of claim 14, wherein a length of the first duration of the alternate driving mode is substantially the same as a length of the second duration of the alternate driving mode.

16. The method of claim 15, wherein a length of the compensation frame is substantially the same as the length of the first duration of the alternate driving mode and the length of the second duration of the alternate driving mode.

17. The method of claim 14, wherein, in the moving image mode, the gate driver is operated in a normal driving mode such that the gate driver scans all of the gate lines.

18. The method of claim 17, wherein the inserting the compensation frame comprises:

comparing a difference of a grayscale value of a previous image and a grayscale value of a present image to a grayscale threshold when the image transition is occurred in the static image mode; and inserting the compensation frame when the difference of the grayscale value of the previous image and the grayscale value of the present image is greater than the grayscale threshold.

19. The method of claim 17, wherein when the static image driving frequency is equal to or greater than a frequency threshold, the gate driver is operated in a first alternate driving mode, and wherein when the static image driving frequency is less than the frequency threshold, the gate driver is operated in a second alternate driving mode.

20. The method of claim 19, wherein, in the first alternate driving mode, the gate driver exclusively scans odd numbered gate lines in a first duration and even numbered gate lines in a second duration, and wherein, in the second alternate driving mode, the gate driver exclusively scans one fourth of the gate lines in each of a first duration, a second duration, a third duration and a fourth duration.

* * * * *